US012631361B2

(12) United States Patent
Su et al.

(10) Patent No.: US 12,631,361 B2
(45) Date of Patent: May 19, 2026

(54) METHOD AND CONTROL SYSTEM FOR CONTROLLING AN AIR-CONDITIONING SYSTEM

(71) Applicants: NANYANG TECHNOLOGICAL UNIVERSITY, Singapore (SG); THE REGENTS OF THE UNIVERSITY OF CALIFORNIA, Oakland, CA (US)

(72) Inventors: Rong Su, Singapore (SG); Lih Chieh Png, Singapore (SG); Seshadhri Srinivasan, Oakland, CA (US); Kameshwar Poolla, Oakland, CA (US)

(73) Assignees: NANYANG TECHNOLOGICAL UNIVERSITY, Singapore (SG); THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 841 days.

(21) Appl. No.: 17/915,972

(22) PCT Filed: Apr. 6, 2021

(86) PCT No.: PCT/SG2021/050189
§ 371 (c)(1),
(2) Date: Sep. 29, 2022

(87) PCT Pub. No.: WO2021/206632
PCT Pub. Date: Oct. 14, 2021

(65) Prior Publication Data

US 2023/0221029 A1 Jul. 13, 2023

Related U.S. Application Data

(60) Provisional application No. 63/005,483, filed on Apr. 6, 2020.

(51) Int. Cl.
*F24F 11/64* (2018.01)
*F24F 11/46* (2018.01)
(Continued)

(52) U.S. Cl.
CPC ..... *F24F 11/64* (2018.01); *F24F 11/46* (2018.01); *F24F 2110/10* (2018.01);
(Continued)

(58) Field of Classification Search
None
See application file for complete search history.

(56) References Cited

U.S. PATENT DOCUMENTS 6,865,449 B2 3/2005 Dudley
6,868,900 B2 3/2005 Dage et al.
(Continued)

FOREIGN PATENT DOCUMENTS

CN 108800426 A 11/2018
SG 11201706843 R 9/2017
(Continued)

OTHER PUBLICATIONS

Png et al., "An internet of things upgrade for smart and scalable heating, ventilation and air-conditioning control in commercial buildings," *Applied Energy* 239:408-424, https://doi.org/10.1016/j.apenergy.2019.01.229, available online Feb. 4, 2019.

*Primary Examiner* — Thomas C Lee
*Assistant Examiner* — Anzuman Sharmin
(74) *Attorney, Agent, or Firm* — Seed IP Law Group LLP

(57) ABSTRACT

There is provided a method of controlling an air-conditioning system associated with a building for optimizing a plurality of building performance parameters in providing an environment with respect to a zone of the building, the method comprising: obtaining zone environmental condition information including zone temperature data associated to the zone, and cooling air temperature data associated to an air handling unit associated to the zone; obtaining, from a zone model generator, zone cooling load parameters associated to the zone with respect to a plurality of time periods
(Continued)

and a zone thermal dynamic model; obtaining, from a scheduler, a sequence of optimal cool air supply rates with respect to a plurality of subsequent time periods with respect to the zone determined based on a multi-component cost function including a plurality of components relating to the plurality of building performance parameters; determining, based on the zone thermal dynamic model, a sequence of zone controller set-points corresponding to the sequence of optimal cool air supply rates with respect to the zone using the zone cooling load parameters, the sequence of optimal cool air supply rates, the zone temperature data and the cooling air temperature data associated to the air handling unit; and sending the sequence of zone controller set-points to a zone controller for controlling a temperature of the zone.

20 Claims, 12 Drawing Sheets

(51) Int. Cl.
*F24F 110/10* (2018.01)
*F24F 110/20* (2018.01)
*F24F 110/70* (2018.01)
*F24F 120/10* (2018.01)

(52) U.S. Cl.
CPC ..... *F24F 2110/20* (2018.01); *F24F 2110/70* (2018.01); *F24F 2120/10* (2018.01)

(56) References Cited

U.S. PATENT DOCUMENTS

| | | | | |
|---|---|---|---|---|
| 6,997,390 | B2 | 2/2006 | Alles | |
| 7,809,472 | B1 | 10/2010 | Silva et al. | |
| 8,185,245 | B2 | 5/2012 | Amundson et al. | |
| 8,521,332 | B2 | 8/2013 | Tiemann et al. | |
| 9,568,924 | B2 | 2/2017 | Federspiel | |
| 2006/0097062 | A1 | 5/2006 | Cheong et al. | |
| 2006/0097063 | A1 | 5/2006 | Zeevi | |
| 2008/0277486 | A1 | 11/2008 | Seem et al. | |
| 2011/0127340 | A1 | 6/2011 | Aiken | |
| 2012/0283881 | A1 | 11/2012 | Federspiel | |
| 2012/0330465 | A1* | 12/2012 | O'Neill | F24F 11/64 700/276 |
| 2013/0085614 | A1 | 4/2013 | Wenzel et al. | |
| 2013/0274940 | A1 | 10/2013 | Wei et al. | |
| 2014/0379141 | A1 | 12/2014 | Patil et al. | |
| 2016/0223218 | A1 | 8/2016 | Barrett | |
| 2018/0142915 | A1* | 5/2018 | Mady | F24F 11/63 |
| 2018/0341255 | A1* | 11/2018 | Turney | G05B 23/0283 |
| 2019/0242601 | A1* | 8/2019 | Coogan | F04D 27/004 |
| 2020/0041965 | A1* | 2/2020 | Patel | F28D 20/0034 |

FOREIGN PATENT DOCUMENTS

| | | | |
|---|---|---|---|
| WO | WO 0157489 | A1 | 8/2001 |
| WO | WO 2016148651 | A1 | 9/2016 |

* cited by examiner

700

900

Token-Based

| | | | Cooling |
|---|---|---|---|
| | | KWH | RTh |
| 8/4/2019 | Mon | 34.5 | 211.3 |
| 9/4/2019 | Tue | 32.3 | 197.5 |
| 10/4/2019 | Wed | 31.2 | 186.8 |
| 11/4/2019 | Thu | 27.4 | 178.1 |
| 12/4/2019 | Fri | 27.2 | 169.5 |
| 22/4/2019 | Mon | 36.2 | 185.1 |
| 23/4/2019 | Tue | 33.9 | 171 |
| 24/4/2019 | Wed | 32.6 | 163.4 |
| 25/4/2019 | Thu | 30 | 160.1 |
| 26/4/2019 | Fri | 26.2 | 127.1 |
| 2/5/2019 | Thu | 35.2 | 188.9 |
| 3/5/2019 | Fri | 33.8 | 172.2 |
| | | | |
| | Average | 31.7 | 175.9 |

Clean (Baseline)

| | | | Cooling |
|---|---|---|---|
| | | KWH | RTh |
| 1/4/2019 | Mon | 41.1 | 223.1 |
| 2/4/2019 | Tue | 36.7 | 198.8 |
| 3/4/2019 | Wed | 31.9 | 175.6 |
| 4/4/2019 | Thu | 34.2 | 190.3 |
| 5/4/2019 | Fri | 35.7 | 183.9 |
| 15/4/2019 | Mon | 38.6 | 215.8 |
| 16/4/2019 | Tue | 35.8 | 216.1 |
| 17/4/2019 | Wed | 37.7 | 213.4 |
| 18/4/2019 | Thu | 33.2 | 203.5 |
| | | | |
| | | | |
| | Average | 36.1 | 202.3 |

| | |
|---|---|
| Average AHU Fan Energy Savings per day | 4.4 kWh |
| | 12% |
| Average AHU Cooling Energy Savings per day | 26.4 RTh |
| | 13% |

FIG. 12

METHOD AND CONTROL SYSTEM FOR CONTROLLING AN AIR-CONDITIONING SYSTEM

CROSS-REFERENCE TO RELATED APPLICATION

This application claims the benefit of priority of U.S. Provisional Patent Application No. 63/005,483, filed on 6 Apr. 2020, the content of which being hereby incorporated by reference in its entirety for all purposes.

TECHNICAL FIELD

The present invention generally relates to a method of controlling an air-conditioning system associated with a building and a control system thereof, and more particularly, for optimizing a plurality of building performance parameters in providing an environment (e.g., a desired indoor environment) with respect to a zone of the building.

BACKGROUND

Buildings consume significant energy and the air-conditioning system such as Heating, Ventilation and Air Conditioning (HVAC) systems contribute to significant proportion of such consumption. Commercial HVAC systems are either Variable Air Volume (VAV) or Variable Refrigerant Volume (VRV)-type systems supplying cooling energy to multiple zones. The controllers for such systems can vary from being a simple thermostat to an optimization-based controller (e.g., Model Predictive Control). Many HVAC control methods have a centralized architecture and aim to minimize energy consumption across all zones using MPC due to its ability to handle complicated constraints, nonlinear dynamics, and physical behaviors. However, due to computational difficulties with a large number of zones and implementation issues centralized control architecture is unsuitable due to computation complexity. Therefore, decentralized control methods have been proposed to overcome this problem. Several methods previously disclosed for improving control of an air-conditioning system for buildings using various control methods will now be briefly mentioned below.

U.S. Pat. No. 9,568,924 B2, by Clifford C. Federspiel (2017), "Methods and Systems for Coordinating the Control of HVAC Units", describes a control technique wherein a supervisory controller receives feedback signal from a plurality of environmental sensors and uses a set of reference values to determine the control signals that actuate HVAC units using a pseudo-inverse of a transfer function matrix. Then the control signals are computed using the transfer function matrix from error signals (the difference between feedback and reference). The method described had a limited fault-diagnosis capability as well. U.S. Pat. No. 8,521,332 B2, by Tiemann et al. (2013), "Actuator for HVAC systems and method for operating the actuator", proposed a method for operating the actuator comprising of a network interface for connecting the actuator to sensor/actuator bus, a data store and a processor connected to a data store. However, the method does not deal with the control technique being used.

A method to update real-time values function estimates through parallel and reinforcement learning was proposed in U.S. Patent Publication No. 2016/0223218 A1, by Barret, Enda (2013), "Automated control and parallel learning HVAC apparatuses, methods and systems". The objective was to maximize quality of experience and minimize energy in regulated environmental spaces by coordinating thermostat set-points.

The use of monitoring units that gather information from multiple locations to define the heating/cooling demand in different locations was proposed in U.S. Pat. No. 6,865,449 B2, by Dudley, Kevin F. (2005), "Location adjusted HVAC control". U.S. Pat. No. 6,868,900 B2, by Dage et al. (2005), "Multiple zone automatic HVAC control system and method" proposed a multiple zone automatic HVAC control system and method for vehicles. The control system had plurality of sensors and mechanisms to control the temperature and flow of air from the HVAC system into multiple zones. PCT International Publication No. WO 01/57489 A1, by Kline et al. WO (2001), "HVAC control using internet" described an approach to control the HVAC system using the Internet. This patent application publication proposed an apparatus and process for controlling the HVAC system.

A low cost and easy to install zone climate control system for retrofitting an existing forced air HVAC system, that can provide independent minute-by-minute, day-by-day and room-by-room climate control was proposed in U.S. Pat. No. 6,997,390 B2, by Alles (2006), "Retrofit HVAC zone climate control system". This U.S. patent publication provided options for the users to program the set-points, specify temperature schedules, providing local temperature control, and display energy usage for different comfort requirements. An environmental control system for a plurality of zones within a building with a plurality HVAC unit was proposed in U.S. Pat. No. 7,809,472 B2, by Silva et al. (2010), "Control system for multiple heating, ventilation and air conditioning units". In this patent publication, multiple controllers were connected to the thermostat for controlling the HVAC system unit in accordance with an output from the temperature sensor. A link interconnects the plurality of the sensors into a network. The device can be networked and can be operated in overlap or non-overlap mode.

A method to use multiple schedules that are entered using a user interface for HVAC system and a controller unit for commanding them was presented in U.S. Pat. No. 8,185,245 B2, by Amundson et al. (2012), "HVAC control with utility time of day pricing support". A wireless remote terminal that includes a transmitter for sending information to an HVAC electronic controller and to one additional remote terminal, a receiver adapted for receiving the information was proposed in U.S. Patent Publication No. 2006/0097063 A1, by Zeevi (2006), "Modular HVAC control system". A method to control HVAC systems based on occupancy information was described in U.S. Patent Publication No. 2008/0277486 A1, by Seem et al. (2008), "HVAC control system and method". An occupancy-based demand controlled ventilation was described in U.S. Patent Publication No. 2011/0127340 A1, by Aiken, Thomas D. (2011), "Occupancy-based demand controlled ventilation system". Further, U.S. Patent Publication No. 2013/0085614 A1, by Wenzel et al. (2013), "Systems and methods for controlling energy use in a building management system using energy budgets" designed a feedback controller that generates manipulated variables based on energy use set-points and measured energy use.

A cloud enabled building automation system wherein information can be received from the cloud through user interfaces and the generation of optimized control signals was described in U.S. Patent Publication No. 2013/0274940 A1, by Wei et al. (2013), "Cloud enabled building automation system". Creating a localized dynamic system for HVAC control in zones was described in U.S. Patent Publication No. 2014/0379141 A1, by Patil et al. (2014), "Zone based heating, ventilation and air-conditioning (HVAC) control using extensive temperature monitoring".

A need therefore exists to provide a method of controlling an air-conditioning system associated with a building and a control system thereof, that seek to overcome, or at least ameliorate, one or more of the deficiencies in conventional methods or control systems for controlling air-conditioning system(s), such as but not limited to, enhancing building performances in providing an environment (e.g., a desired indoor environment) in a zone of a building, and more particularly, in a flexible and decentralized manner with significant energy saving. It is against this background that the present invention has been developed.

SUMMARY

According to a first aspect of the present invention, there is provided a method of controlling an air-conditioning system associated with a building for optimizing a plurality of building performance parameters in providing an environment with respect to a zone of the building, using at least one processor, the method comprising:

obtaining zone environmental condition information including zone temperature data associated to the zone, and cooling air temperature data associated to an air handling unit associated to the zone;

obtaining, from a zone model generator, zone cooling load parameters associated to the zone with respect to a plurality of time periods and a zone thermal dynamic model;

obtaining, from a scheduler, a sequence of optimal cool air supply rates with respect to a plurality of subsequent time periods with respect to the zone determined based on a multi-component cost function including a plurality of components relating to the plurality of building performance parameters;

determining, based on the zone thermal dynamic model, a sequence of zone controller set-points corresponding to the sequence of optimal cool air supply rates with respect to the zone using the zone cooling load parameters, the sequence of optimal cool air supply rates, the zone temperature data and the cooling air temperature data associated to the air handling unit; and sending the sequence of zone controller set-points to a zone controller for controlling a temperature of the zone.

According to a second aspect of the present invention, there is provided a control system for controlling an air-conditioning system associated with a building for optimizing a plurality of building performance parameters in providing an environment with respect to a zone of the building, the control system comprising:

a memory; and at least one processor communicatively coupled to the memory and configured to:

obtain zone environmental condition information including zone temperature data associated to the zone, and cooling air temperature data associated to an air handling unit associated to the zone;

obtain, from a zone model generator, zone cooling load parameters associated to the zone with respect to a plurality of time periods and a zone thermal dynamic model;

obtain, from a scheduler, a sequence of optimal cool air supply rates with respect to a plurality of subsequent time periods with respect to the zone determined based on a multi-component cost function including a plurality of components relating to the plurality of building performance parameters;

determine, based on the zone thermal dynamic model, a sequence of zone controller set-points corresponding to sequence of optimal cool air supply rates with respect to the zone using the zone cooling load parameters, the sequence of optimal cool air supply rates, the zone temperature data and the cooling air temperature data associated to the air handling unit; and send the sequence of zone controller set-points to a zone controller for controlling a temperature of the zone.

BRIEF DESCRIPTION OF THE DRAWINGS

Embodiments of the present invention will be better understood and readily apparent to one of ordinary skill in the art from the following written description, by way of example only, and in conjunction with the drawings, in which:

FIG. 12 shows a table illustrating experimental data for energy saving potential based on data from a test-bed according to various example embodiments of the present invention.

DETAILED DESCRIPTION

Various embodiments of the present invention provide a method of controlling an air-conditioning system associated with a building and a control system thereof, and more particularly, for optimizing a plurality of building performance parameters in providing an environment (e.g., a desired indoor environment) with respect to a zone of the building. It will be appreciated by a person skilled in the art that the above-mentioned zone may refer to any one or more regions or enclosures or enclosed areas within a building, such as but not limited to, a room (e.g., an office room, a meeting room, an apartment room, a hotel room and so on), an open-plan office space, a lecture hall, a theatre, so on. It will be appreciated by a person skilled in the art that the above-mentioned environment may refer an indoor environment within the zone conditioned or regulated by the air-conditioning system. It will also be appreciated by a person skilled in the art that the method of controlling an air-conditioning system and a control system thereof, for optimizing a plurality of building performance parameters in providing an environment with respect to a zone of the building, may also be applied or employed with respect to each zone (e.g., each predetermined or selected zone) of the building. Accordingly, the building performance parameters with respect to each zone of the building may be optimized.

Figure 1:
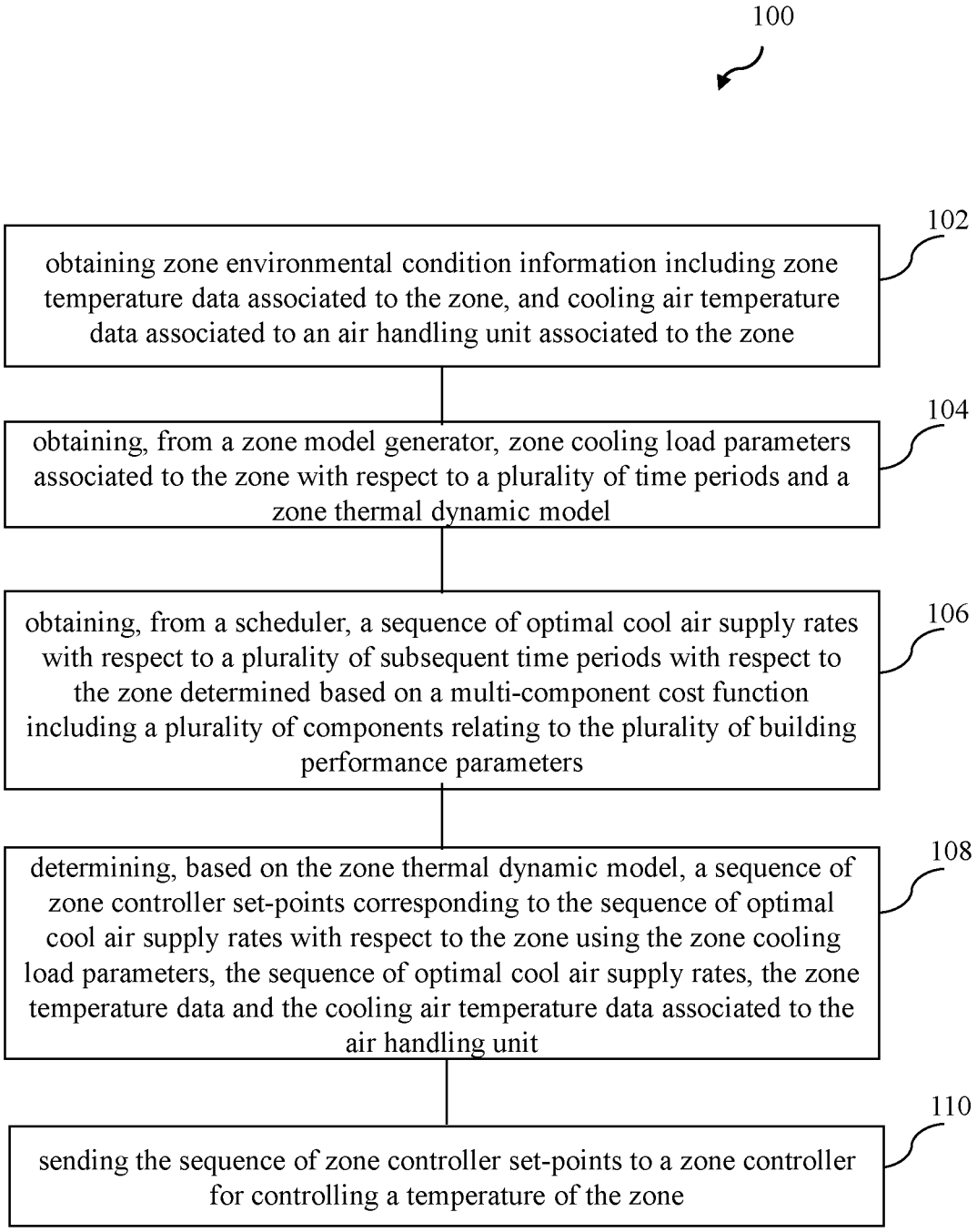
FIG. 1 depicts a flow diagram of a method of controlling an air-conditioning system associated with a building for optimizing a plurality of building performance parameters in providing an environment with respect to a zone of the building, according to various embodiments of the present invention.

FIG. 1 depicts a flow diagram of a method 100 of controlling an air-conditioning system associated with a building for optimizing a plurality of building performance parameters in providing an environment with respect to a zone of the building, using at least one processor. The method 100 comprises: obtaining (at 102), zone environmental condition information including zone temperature data associated to the zone, and cooling air temperature data associated to an air handling unit associated to the zone; obtaining (at 104), from a zone model generator, zone cooling load parameters associated to the zone with respect to a plurality of time periods (which may also be interchangeably referred to herein as time intervals) and a zone thermal dynamic model; obtaining (at 106), from a scheduler, a sequence of optimal cool air supply rates with respect to a plurality of subsequent time periods with respect to the zone determined based on a multi-component cost function including a plurality of components relating to the plurality of building performance parameters; determining, (at 108), based on the zone thermal dynamic model, a sequence of zone controller set-points (with respect to the plurality of subsequent time periods with respect to the zone) corresponding to the sequence of optimal cool air supply rates with respect to the zone using the zone cooling load parameters, the sequence of optimal cool air supply rates, the zone temperature data and the cooling air temperature data associated to the air handling unit; and sending (at 110), the sequence of zone controller set-points to a zone controller for controlling a temperature of the zone.

In various embodiments, the time periods or intervals may refer to instants of time or time instants.

In various embodiments, the above-mentioned providing an environment with respect to a zone of the building may refer to conditioning or regulating the environment in or within the zone.

In various embodiments, the above-mentioned air-conditioning system may include, but is not limited to, a heating, ventilation and air-conditioning (HVAC) system. It will be appreciated that the present invention is not limited to any particular or specific air-conditioning system, as long as it is capable of being controlled based on inputs to condition or regulate the environment in the zone at least with respect to temperature.

In various embodiments, the above-mentioned obtaining zone environmental condition information including zone temperature data associated to the zone comprises obtaining, from a zone sensor module, zone temperature measurement data associated to the zone with respect to a current time (e.g., zone ambient temperature measurement associated to the zone).

In various embodiments, the above-mentioned subsequent time periods may be future time periods.

In various embodiments, the above-mentioned obtaining zone environmental condition information including zone temperature data associated to the zone comprises obtaining, from the zone model generator, zone temperature data associated to the zone with respect to the plurality of subsequent time periods. Accordingly, the zone temperature data associated to the zone with respect to the plurality of subsequent time periods may be predicted zone temperature associated to the zone with respect to future time periods.

In various embodiments, the above-mentioned obtaining cooling air temperature data associated to an air handling unit associated to the zone comprises obtaining the cooling air temperature measurement data associated to the air handling unit associated to the zone with respect to the current time. The cooling air temperature associated to the air handling unit associated to the zone may be obtained from a Building Energy Management System or one or more sensors located at the air handling unit. For example, a Building Energy Management System may include a sensor installed in the air handling unit for measuring the cooling air temperature.

In various embodiments, the zone thermal dynamic model is trained by the model generator based on measured data of zone temperature associated to the zone, zone cool air supply rate associated to the zone and cooling air temperature associated to the air handling unit associated to the zone. In various embodiments, the zone thermal dynamic model is trained by the model generator based on the measured data for predicting the zone temperature associated to the zone with respect to subsequent discrete time instants.

In various embodiments, the above-mentioned zone controller set-points may be thermal set-points. In various embodiments, the sequence of zone controller set-points may be a schedule of zone controller set-points (e.g., zone controller set-points over a prediction horizon such as 21° C. at 10 am, 22° C. at 10:15 am, 24° C. at 10:30 am, etc).

In various embodiments, the plurality of components of the multi-component cost function comprise a first component relating to zone occupancy associated to the zone determined based on a zone occupancy detection model, a second component relating to fan power of the air handling unit determined based on a fan power function, a third component relating to chiller power determined based on a chiller power function, a fourth component relating to coupling of a pressure of a supply fan associated to the air handling unit and zone air flow rates corresponding to zones associated to the air handling unit determined based on a coupling function in relation to the pressure of the supply fan associated to the air handling unit and the zone air flow rates corresponding to zones associated to the air handling unit.

In various embodiments, the zone thermal dynamic model, the zone occupancy detection model, the fan power function, the chiller power function and the coupling function in relation to the pressure of the supply fan associated to the air handling unit and/or the zone air flow rates corresponding to the zones associated to the air handling unit may involve training (e.g., is produced by being trained) in the zone model generator based on labelled data to make a prediction or estimation (output) for a given input. In a non-limiting example, the zone thermal dynamic model may be learned in the zone model generator based on a linear regression model with the least squares estimation method. For example, the zone occupancy detection model, the fan power function, the chiller power function and the coupling function in relation to the pressure of the supply fan associated to the air handling unit and/or the zone air flow rates corresponding to the zones associated to the air handling unit may be derived via machine learning methods. In other embodiments, non-linear regression models may be used to describe the fan power function and the chiller power function. The zone thermal dynamic model, the zone occupancy detection model, the fan power function, the chiller power function and the coupling function in relation to the pressure of the supply fan associated to the air handling unit and/or the zone air flow rates corresponding to the zones associated to the air handling unit may be learned models in the zone model generator based on measured data.

In various embodiments, the zone cooling load parameters associated to the zone with respect to the plurality of time periods may be determined based on the learned zone thermal dynamic model in the zone model generator. For example, the zone cooling load parameters associated to the zone may be with respect to the current time period and the subsequent time periods (e.g., $Q_i(t_0)$, . . . , $Q_i(t_0+K)$). Accordingly, the above-mentioned obtaining, from a zone model generator, zone cooling load parameters associated to the zone with respect to a plurality of time periods may include obtaining zone cooling load parameters associated to the zone with respect to the current time period and the subsequent time periods.

In various embodiments, a zone cooling load parameter of the above-mentioned zone cooling load parameters may refer to the amount of heat energy that need to be removed from a given space to maintain the temperature in an acceptable range. For example, the zone cooling load parameter (or ambient cooling load) may refer to an amount of heat energy accumulated within some time interval. The value of a zone cooling load parameter Q(t) may refer to the specific cooling load value measured at time instant t.

In various embodiments, the ambient cooling load may be assumed to be captured by a piecewise constant function, that is, its value maintains a constant over a certain time period and may changes to another constant for the next time period. This piecewise constant function may be determined based on a standard parameter estimation algorithm within the zone model generator.

In various embodiments, the plurality of components of the multi-component cost function further comprise a component (fifth component) relating to respective zone cool air supply rate requests corresponding to the zone and one or more other zones in the building with respect to the plurality of subsequent time periods.

In various embodiments, the plurality of components of the multi-component cost function further comprise a component (sixth component) relating to occupant thermal comfort.

In various embodiments, the component relating to occupant thermal comfort comprises a thermal set-point obtained from a predetermined value, predicted based on an occupant thermal comfort prediction model or obtained from user input.

In various embodiments, the method 100 further comprises predicting, based on the occupant thermal comfort prediction model, the occupant thermal comfort using the zone temperature data, zone humidity data, zone carbon dioxide concentration data and zone cool air supply rate data associated to the zone obtained from the zone sensor module.

In various embodiments, the zone controller comprises a zone variable air volume (VAV) controller. In various embodiments, the zone controller set-points may be actual control signals which is sent to the zone HVAC variable air volume controller associated to the zone. The zone controller set-points may be zone thermal set-points which is a range of temperature. For example, the zone variable air volume controller may adjust the variable air volume damper to ensure that the zone temperature of the zone will reach the zone thermal set-points, which indirectly reflect the sequence of optimal cool air supply rates with respect to a plurality of subsequent time periods (or cooling air supply schedule) from the scheduler. The damper may be located inside the zone VAV box (e.g., not the damper in the AHU).

In various embodiments, the plurality of building performance parameters may include a building energy efficiency parameter and an occupant thermal comfort parameter.

In various embodiments, the above-mentioned scheduler may solve a scheduling problem (e.g., corresponding to the "multi-component cost function" described hereinbefore according to various embodiments) for obtaining a sequence of optimal cool air supply rates with respect to a plurality of subsequent time periods for each of a plurality of zones in the building based on the multi-component cost function to optimize the plurality of building performance parameters (e.g., of building energy efficiency and occupant thermal comfort) in providing the environment (e.g., desired indoor environment) with respect to the zones in the building. The scheduler may be based on a distributed model predictive control (MPC) scheme such as described in PCT Application No. PCT/SG2016/050122 published as PCT International Publication No. WO 2016/148651 A1, by Rong et al. (2016), "Method of operating a building environment management system", which provides a scalable distributed scheduling and control approach for HVAC systems.

Accordingly, various embodiments provide an implementation framework of data collection and analysis that facilitates deployment of the distributed model predictive controller (MPC) for HVAC control. The method 100 of controlling an air-conditioning system associated with a building according to various embodiments of the present invention advantageously provides a way to flexibly configure decentralized control on-the-fly over an existing Building Energy Management Systems (BEMS) or as a standalone system to control the air-conditioning system for optimizing a plurality of building performance parameters in providing an environment (e.g., desired indoor environment) with respect to the zone of the building with significant energy saving. Further, the method of controlling an air-conditioning system associated with a building according to various embodiments may provide a scalable and adaptive implementation architecture that supports distributed optimal control for multi-zone commercial Heating, Ventilation and Air Conditioning (HVAC) systems.

Figure 2:
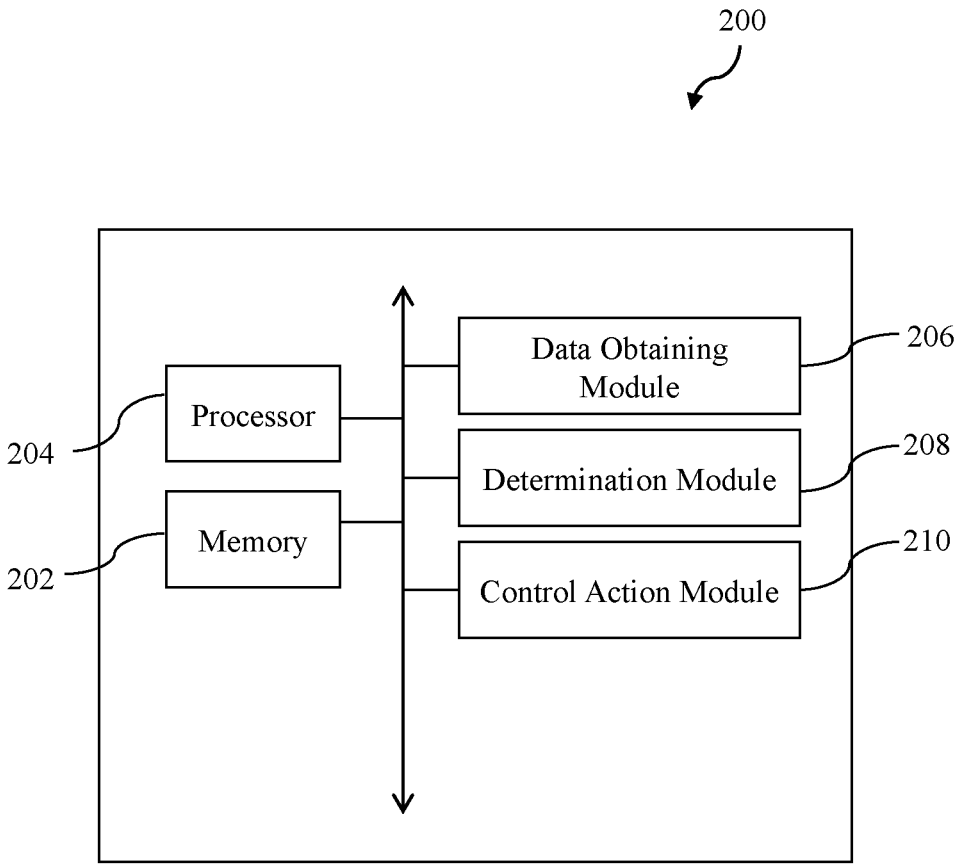
FIG. 2 depicts a schematic block diagram of a control system for controlling an air-conditioning system associated with a building for optimizing a plurality of building performance parameters in providing an environment with respect to a zone of the building, according to various embodiments of the present invention, such as corresponding to the method shown in FIG. 1.

FIG. 2 depicts a schematic block diagram of a control system 200 for controlling an air-conditioning system associated with a building for optimizing a plurality of building performance parameters in providing an environment with respect to a zone of the building, according to various embodiments of the present invention, such as corresponding to the method 100 of controlling an air-conditioning system as described hereinbefore according to various embodiments of the present invention. The control system 200 comprises a memory 202, and at least one processor 204 communicatively coupled to the memory 202 and configured to: obtain zone environmental condition information including zone temperature data associated to the zone, and cooling air temperature data associated to an air handling unit associated to the zone; obtain, from a zone model generator, zone cooling load parameters associated to the zone with respect to a plurality of time periods and a zone thermal dynamic model; obtain, from a scheduler, a sequence of optimal cool air supply rates with respect to a plurality of subsequent time periods with respect to the zone determined based on a multi-component cost function including a plurality of components relating to the plurality of building performance parameters; determine, based on the zone thermal dynamic model, a sequence of zone controller set-points corresponding to sequence of optimal cool air supply rates with respect to the zone using the zone cooling load parameters, the sequence of optimal cool air supply rates, the zone temperature data and the cooling air temperature data associated to the air handling unit; and send the sequence of zone controller set-points to a zone controller for controlling a temperature of the zone.

It will be appreciated by a person skilled in the art that the at least one processor 204 may be configured to perform the required functions or operations through set(s) of instructions (e.g., software modules) executable by the at least one processor 204 to perform the required functions or operations. Accordingly, as shown in FIG. 2, the system 200 may comprise a data obtaining module (or a data obtaining circuit) 206 configured to obtain zone environmental condition information including zone temperature data associated to the zone, and cooling air temperature data associated to an air handling unit associated to the zone, obtain, from a zone model generator, zone cooling load parameters associated to the zone with respect to a plurality of time periods and a zone thermal dynamic model, and obtain, from a scheduler, a sequence of optimal cool air supply rates with respect to a plurality of subsequent time periods with respect to the zone determined based on a multi-component cost function including a plurality of components relating to the plurality of building performance parameters; a determination module (or a determination circuit) 208 configured to determine, based on the zone thermal dynamic model, a sequence of zone controller set-points corresponding to the sequence of optimal cool air supply rates with respect to the zone using the zone cooling load parameters, the sequence of optimal cool air supply rates, the zone temperature data and the cooling air temperature data associated to the air handling unit; and a control action module (or a control action circuit) 210 configured to send the sequence of zone controller set-points to a zone controller for controlling a temperature of the zone.

It will be appreciated by a person skilled in the art that the above-mentioned modules are not necessarily separate modules, and one or more modules may be realized by or implemented as one functional module (e.g., a circuit or a software program) as desired or as appropriate without deviating from the scope of the present invention. For example, two or more of the data obtaining module 206, the determination module 208, and the control action module 210 may be realized (e.g., compiled together) as one executable software program (e.g., software application or simply referred to as an "app"), which for example may be stored in the memory 202 and executable by the at least one processor 204 to perform the functions/operations as described herein according to various embodiments.

In various embodiments, the system 200 corresponds to the method 100 as described hereinbefore with reference to FIG. 1, therefore, various functions or operations configured to be performed by the least one processor 204 may correspond to various steps of the method 100 described hereinbefore according to various embodiments, and thus need not be repeated with respect to the system 200 for clarity and conciseness. In other words, various embodiments described herein in context of the methods are analogously valid for the respective systems, and vice versa.

For example, in various embodiments, the memory 202 may have stored therein the data obtaining module 206, the determination module 208, and/or the control action module 210, which respectively correspond to various steps of the method 100 as described hereinbefore according to various embodiments, which are executable by the at least one processor 204 to perform the corresponding functions/operations as described herein.

A computing system, a controller, a microcontroller or any other system providing a processing capability may be provided according to various embodiments in the present disclosure. Such a system may be taken to include one or more processors and one or more computer-readable storage mediums. For example, the system 200 described hereinbefore may include a processor (or controller) 204 and a computer-readable storage medium (or memory) 202 which are for example used in various processing carried out therein as described herein. A memory or computer-readable storage medium used in various embodiments may be a volatile memory, for example a DRAM (Dynamic Random Access Memory) or a non-volatile memory, for example a PROM (Programmable Read Only Memory), an EPROM (Erasable PROM), EEPROM (Electrically Erasable PROM), or a flash memory, e.g., a floating gate memory, a charge trapping memory, an MRAM (Magnetoresistive Random Access Memory) or a PCRAM (Phase Change Random Access Memory).

In various embodiments, a "circuit" may be understood as any kind of a logic implementing entity, which may be special purpose circuitry or a processor executing software stored in a memory, firmware, or any combination thereof. Thus, in an embodiment, a "circuit" may be a hard-wired logic circuit or a programmable logic circuit such as a programmable processor, e.g., a microprocessor (e.g., a Complex Instruction Set Computer (CISC) processor or a Reduced Instruction Set Computer (RISC) processor). A "circuit" may also be a processor executing software, e.g., any kind of computer program, e.g., a computer program using a virtual machine code, e.g., Java. Any other kind of implementation of the respective functions which will be described in more detail below may also be understood as a "circuit" in accordance with various alternative embodiments. Similarly, a "module" may be a portion of a system according to various embodiments in the present invention and may encompass a "circuit" as above, or may be understood to be any kind of a logic-implementing entity therefrom.

Some portions of the present disclosure are explicitly or implicitly presented in terms of algorithms and functional or symbolic representations of operations on data within a computer memory. These algorithmic descriptions and functional or symbolic representations are the means used by those skilled in the data processing arts to convey most effectively the substance of their work to others skilled in the art. An algorithm is here, and generally, conceived to be a self-consistent sequence of steps leading to a desired result. The steps are those requiring physical manipulations of physical quantities, such as electrical, magnetic or optical signals capable of being stored, transferred, combined, compared, and otherwise manipulated.

Unless specifically stated otherwise, and as apparent from the following, it will be appreciated that throughout the present specification, discussions utilizing terms such as "obtaining", "determining", "sending", "controlling" or the like, refer to the actions and processes of a computer system, or similar electronic device, that manipulates and transforms data represented as physical quantities within the computer system into other data similarly represented as physical quantities within the computer system or other information storage, transmission or display devices.

The present specification also discloses a system (e.g., which may also be embodied as a device or an apparatus), such as the system 200, for performing the operations/functions of the methods described herein. Such a system may be specially constructed for the required purposes, or may comprise a general purpose computer or other device selectively activated or reconfigured by a computer program stored in the computer. The algorithms presented herein are not inherently related to any particular computer or other apparatus. Various general-purpose machines may be used with computer programs in accordance with the teachings herein. Alternatively, the construction of more specialized apparatus to perform the required method steps may be appropriate.

In addition, the present specification also at least implicitly discloses a computer program or software/functional module, in that it would be apparent to the person skilled in the art that the individual steps of the methods described herein may be put into effect by computer code. The computer program is not intended to be limited to any particular programming language and implementation thereof. It will be appreciated that a variety of programming languages and coding thereof may be used to implement the teachings of the disclosure contained herein. Moreover, the computer program is not intended to be limited to any particular control flow. There are many other variants of the computer program, which can use different control flows without departing from the spirit or scope of the invention. It will be appreciated by a person skilled in the art that various modules described herein (e.g., the data obtaining module 206, the determination module 208, and/or the control action module 210) may be software module(s) realized by computer program(s) or set(s) of instructions executable by a computer processor to perform the required functions, or may be hardware module(s) being functional hardware unit(s) designed to perform the required functions. It will also be appreciated that a combination of hardware and software modules may be implemented.

Furthermore, one or more of the steps of a computer program/module or method described herein may be performed in parallel rather than sequentially. Such a computer program may be stored on any computer readable medium. The computer readable medium may include storage devices such as magnetic or optical disks, memory chips, or other storage devices suitable for interfacing with a general purpose computer. The computer program when loaded and executed on such a general-purpose computer effectively results in an apparatus that implements the steps of the methods described herein.

In various embodiments, there is provided a computer program product, embodied in one or more computer-readable storage mediums (non-transitory computer-readable storage medium), comprising instructions (e.g., the data obtaining module 206, the determination module 208, and/or the control action module 210) executable by one or more computer processors to perform a method 100 of controlling an air-conditioning system as described hereinbefore with reference to FIG. 1. Accordingly, various computer programs or modules described herein may be stored in a computer program product receivable by a system therein, such as the system 200 as shown in FIG. 2, for execution by at least one processor 204 of the system 200 to perform the required or desired functions.

The software or functional modules described herein may also be implemented as hardware modules. More particularly, in the hardware sense, a module is a functional hardware unit designed for use with other components or modules. For example, a module may be implemented using discrete electronic components, or it can form a portion of an entire electronic circuit such as an Application Specific Integrated Circuit (ASIC). Numerous other possibilities exist. Those skilled in the art will appreciate that the software or functional module(s) described herein can also be implemented as a combination of hardware and software modules.

Figure 3:
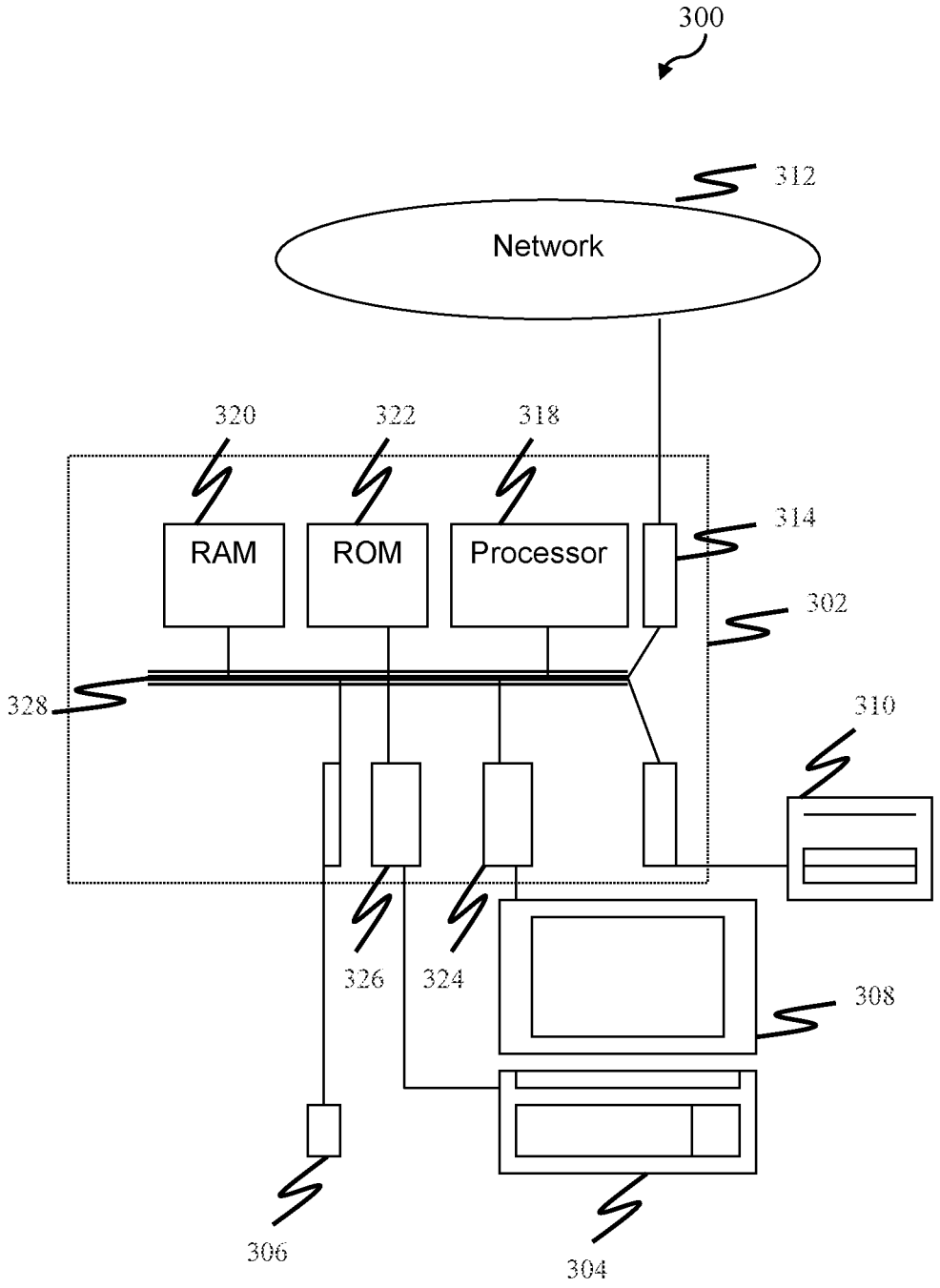
FIG. 3 depicts a schematic block diagram of an exemplary computer system in which a control system for controlling an air-conditioning system associated with a building, according to various embodiments of the present invention, may be realized or implemented.

In various embodiments, the system 200 may be realized by any computer system (e.g., desktop or portable computer system) including at least one processor and a memory, such as a computer system 300 as schematically shown in FIG. 3 as an example only and without limitation. Various methods/steps or functional modules (e.g., the data obtaining module 206, the determination module 208, and/or the control action module 210) may be implemented as software, such as a computer program being executed within the computer system 300, and instructing the computer system 300 (in particular, one or more processors therein) to conduct the methods/functions of various embodiments described herein. The computer system 300 may comprise a computer module 302, input modules, such as a keyboard 304 and a mouse 306, and a plurality of output devices such as a display 308, and a printer 310. The computer module 302 may be connected to a computer network 312 via a suitable transceiver device 314, to enable access to e.g., the Internet or other network systems such as Local Area Network (LAN) or Wide Area Network (WAN). The computer module 302 in the example may include a processor 318 for executing various instructions, a Random Access Memory (RAM) 320 and a Read Only Memory (ROM) 322. The computer module 302 may also include a number of Input/Output (I/O) interfaces, for example I/O interface 324 to the display 308, and I/O interface 326 to the keyboard 304. The components of the computer module 302 typically communicate via an interconnected bus 328 and in a manner known to the person skilled in the relevant art.

It will be appreciated by a person skilled in the art that the terminology used herein is for the purpose of describing various embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In order that the present invention may be readily understood and put into practical effect, various example embodiments of the present invention will be described hereinafter by way of examples only and not limitations. It will be appreciated by a person skilled in the art that the present invention may, however, be embodied in various different forms or configurations and should not be construed as limited to the example embodiments set forth hereinafter. Rather, these example embodiments are provided so that this disclosure will be thorough and complete, and will fully convey the scope of the present invention to those skilled in the art.

Various example embodiments relate to an air-conditioning system such as a HVAC system. For the sake of simplicity and clarity and unless stated otherwise, various example embodiments will hereinafter be described with the air-conditioning system being a HVAC system. However, it will be appreciated by a person skilled in the art that the present invention is not limited to a HVAC system and may be any other type of air-conditioning heating system, as long as it is capable of being controlled based on inputs to condition or regulate the environment in a zone of a building at least with respect to temperature. Furthermore, also for the sake of simplicity and clarity and unless stated otherwise, various example embodiments may hereinafter be described with the zone being a single or an individual room of a building.

Various example embodiments provide a specific implementation framework of data collection and analysis (e.g., corresponding to the "method for controlling an air-conditioning system and control system thereof" as described hereinbefore according to various embodiments) that facilitates deployment of a distributed model predictive controller (MPC) for an air-conditioning system control, such as a HVAC control as described in the above-mentioned PCT International Publication No. WO 2016/148651 A1 that is able to optimize for multiple-objectives, and more particularly, building energy efficiency and occupant comfort (thermal comfort). For example, Rong et al. describes a scalable distributed scheduling and control approach for HVAC systems, however, the implementation aspects have not been discussed though the importance of the decentralized architecture and its realization with cost efficient devices has been discussed. In this regard, various example embodiments may relate to an implementation framework for an MPC scheme with multiple-objectives (optimize building energy efficiency, indoor thermal comfort) function to determine optimal control strategies for the air-conditioning system associated with the building having two or more zones to optimize building energy efficiency and occupant thermal comfort to improve building performance. Accordingly, various example embodiments may provide a scalable and adaptive implementation architecture that supports distributed optimal control for multi-zone commercial HVAC systems. The implementation framework is highly scalable and adaptive through deployment of low-cost autonomous zone modules and central optimization unit with effective model learning capabilities. Various embodiments may relate to a method of automating Building Energy Management Systems (BEMS).

The control method or implementation and control system for controlling an air-conditioning system associated with a building will now be described below according to various example embodiments. An experimental study was also conducted in a real building to demonstrate the energy saving brought by the control method according to various example embodiments.

Figure 4:
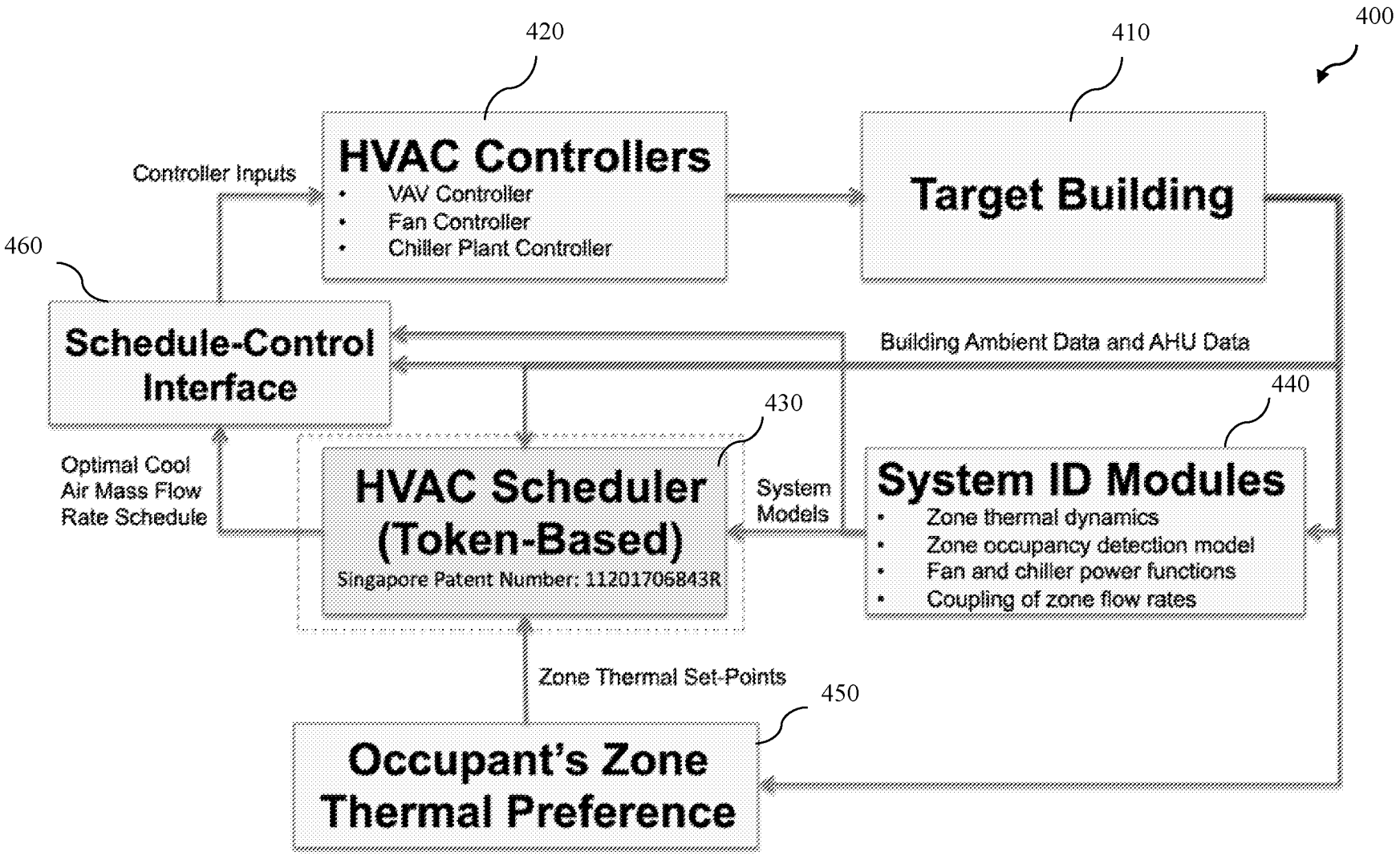
FIG. 4 depicts a schematic drawing showing an example configuration or information architecture of a control system, according to various example embodiments.

FIG. 4 depicts a schematic drawing showing an example configuration or information architecture of a control system 400, according to various example embodiments. The architecture may comprise a target building 410, and a HVAC controllers module 420 such as those in various HVAC systems in the art. For example, the HVAC controllers module 420 may comprise resource controllers such as, but not limited to, VAV controllers, chiller controllers and fan controllers, operating based on ambient data associated to the building and zone thermal set-points (defined as desirable ranges of zone temperature), typically managed by a Building Energy Management System (BEMS). As illustrated, the architecture may comprise a token-based HVAC scheduling algorithm (or TBSA module or scheduler as described hereinbefore according to various embodiments) 430, which is described in detail in PCT Application No. PCT/SG2016/050122 published as PCT International Publication No. WO 2016/148651 A1, by Rong et al. (2016), "Method of operating a building environment management system", the content of which being hereby incorporated by reference in its entirety for all purposes. The scheduler may be configured to output a schedule of optimized set-points for each zone of the building (e.g., over a prediction horizon) to provide optimized energy consumption and occupant thermal comfort, such as by solving the optimization or scheduling problem described by Equations (1)-(6) below, where Equation (6) may be an equivalent variation of Equation (5) to simplify computation.

In various example embodiments, the architecture may further comprise system Identification (ID) modules component (SIDMB or zone model generator as described hereinbefore according to various embodiments) 440, an occupant's zone thermal preference module (OZTPB or zone occupant thermal preference determinator) 450 and a schedule-control interface block or module (SCIB or zone schedule controller) 460. The system ID modules component 440, the occupant's zone thermal preference module 450 and the schedule-control interface module 460 may provide all necessary information for the TBSA module 430 to be implementable, for example, in a building VAV HVAC system.

In various example embodiments, the system ID modules component (or zone model generator) 440 may obtain sensor data periodically from (or associated to) a target building 410 either via relevant sensors directly or via a BEMS, such as data related to the chiller plant and air handling units (AHUs). Upon obtaining those data, relevant model identification algorithms (or learning algorithms) may be applied to learn or determine the following types of models:

a. A zone thermal dynamic model for each zone;
b. A zone occupancy prediction model for each zone;
c. A coupling function or model describing how cool air flow rates of zones in the (or associated to) same AHU are related, with respect to a given AHU fan supply pressure (corresponding to "a coupling function in relation to the pressure of the supply fan associated to the air handling unit and the zone air flow rates corresponding to the zones associated to the air handling unit" as described hereinbefore according to various embodiments);

d. The chiller and AHU fan power functions;

e. A carbon dioxide ($CO_2$) concentration dynamic model, which predicts the needed amount of fresh air for a ventilation purpose.

For example, four types of models may be determined by the zone model generator, including the zone thermal dynamic model for each zone, the zone occupancy prediction model for each zone, the coupling model describing how cool air flow rates of zones associated to same AHU are related, with respect to a given AHU fan supply pressure, and the chiller and AHU fan power functions. In various example embodiments, the carbon dioxide ($CO_2$) concentration dynamic model may be optional and may not be determined by the zone model generator. In various example embodiments, all learned models are sent to the TBSA module, which runs its scheduling process in a model predictive control manner.

In various example embodiments, the occupant's zone thermal preference module (or zone occupant thermal preference determinator) 450 may be configured to generate a real-time individualized zone thermal set-point based on either a pre-determined static set-point value (e.g., in Singapore, a zone set-point is typically set as 23° C. to 26° C. for working hours), or an individualized thermal comfort model that describes a personalized thermal comfort set-point. Such a personalized set-point may vary based on the ambient setting and the occupant's status, which may be derivable from zone data by using machine learning techniques. In other words, the OZTPB or zone occupant thermal preference determinator 450 may be multi-modal based on a static thermal set-point, or a dynamic thermal set-point.

The zone occupant thermal preference determinator 450 may send a zone thermal set-point to the TBSA module either when required by the latter, i.e., in a demand-response manner, or periodically.

In various example embodiments, the SCIB or zone schedule controller 460 may be configured for translating the output of the TBSA module, which are specific schedules of cool air supply rates to individual zones, into proper inputs to relevant zone controllers, after taking into account the real-time building ambient data and the learned system models (or learned models) from the zone model generator, and transmitting them to actual zone controllers. More specifically, for example, considering that most existing VAV controllers take zone temperature as the input and apply suitable control strategies to ensure the zone temperature stay within the stated zone set-point (i.e., the desirable range of zone temperature), the SCIB will undertake the following operations. First, the TBSA module sends to SCIB a sequence $\dot{m}i(t_0+1)$, $\dot{m}_i(t_0+2)$, . . . , $\dot{m}_i(t_0+K)$ of cool air supply rates (corresponding to the sequence of optimal cool air supply rates with respect to a plurality of subsequent time periods as described hereinbefore) for each zone i at time to, specified as a schedule up to a future time instant K, and SIDMB sends to SCIB a zone ambient cooling load prediction model $Q_i(t_0)$, . . . , $Q_i(t_0+K)$ (corresponding to the zone cooling load parameters associated to the zone with respect to a plurality of time periods as described hereinbefore) and a zone thermal dynamic model $T_i(t+1)=f_i(T_i(t), \dot{m}_i(t), T_c(t), Q_i(t))$, where $T_i(t)$ denotes temperature of zone i during the discrete time interval t, $\dot{m}_i(t)$ denotes mass flow rate of cool air supply in zone i during t, $T_c(t)$ denotes temperature of cool air supply during the discrete time interval t, and $Q_i(t)$ denotes ambient cooling load of zone i during the discrete time interval t.

In various example embodiments, the building sensors, such as those installed in each zone module and air handling unit (AHU), will provide the zone temperature data $T_i(t_0)$ (e.g., zone temperature measurement data associated to a zone with respect to a current time) and the AHU cooling air temperature $T_c(t_0)$ (e.g., cooling air temperature measurement data associated to an air handling unit with respect to a current time) to SCIB, assuming that the AHU cooling air temperature will not change up to K time intervals, i.e., $T_c(t_0+1)=\ldots=T_c(t_0+k)=T_c(t_0)$, which is typically true in the existing practice. With such information from the TBSA module, the SIDMB module and the building sensors, the SCIB may calculate the zone temperature points $T_i(t_0+1)$, . . . , $T_i(t_0+K)$, based on the zone thermal dynamic model $f_i$. For example, $T_i(t_0+1)=f_i(T_i(t_0),\dot{m}_i(t_0),T_c(t_0),Q_i(t_0))$. All these calculated temperature points will become zone thermal set-points (corresponding to the zone controller set-points as described hereinbefore) and sent to the relevant zone VAV controller, which will adjust the VAV damper to ensure that the zone temperature will reach those set-points, which indirectly reflect the cooling air supply schedule from the TBSA module. For example, the SCIB needs both cool air supply schedule from the TBSA module and predicted environmental conditions (such as temperature in the future) to generate a sequence of zone thermal set-points (e.g., 21° C. at 10 am, 22° C. at 10:15 am, 24° C. at 10:30 am, etc). When the output of the TBSA module changes, the output of the SCIB module will also change accordingly to ensure a faithful execution of each cool air supply schedule from the TBSA module.

The SIDMB and OZTPB may be applied to any VAV HVAC system. The SCIB, on the other hand, may require a building-specific design (such as different communication protocols used by VAV controllers, e.g., BACnet, LonWorks or Modbus protocol, where for each specific protocol, SCIB needs to have a specific output format) to match the input of a given VAV controller in a target HVAC system.

As described, the information architecture depicted in FIG. 4 may be designed for implementing the scheduler or TBSA, for example, as described in the above-mentioned PCT International Publication No. WO 2016/148651 A1. It solves several key implementation issues shown below, where the innovation resides.

Types of Data to be Collected (What Data to be Collected)

In various example embodiments, the SIDMB or zone model generator 440 may obtain the following sensor data: zone temperature of each zone, zone humidity of each zone, zone carbon dioxide ($CO_2$) concentration of each zone, zone cool air supply rate (or zone cool air flow rate) of each zone, AHU exit cool air temperature of each AHU, AHU fan exit air pressure of each AHU, AHU return air $CO_2$ concentration of each AHU, AHU return air temperature of each AHU, AHU fan consumption power (or energy) of each AHU, AHU fresh air supply rate of each AHU and chiller coefficient of performance (COP) and chiller consumption power. For example, the AHU exit cool air temperature data of each AHU may be used by the zone thermal dynamic model, the AHU fan exit air pressure of each AHU may be used in the process of determine the coupling of cool air supply rates among different zones within a given air duct network, the AHU return air $CO_2$ concentration of each AHU may be used in determining the percentage of fresh air supply in AHU, the AHU return air temperature of each AHU may be used in calculating the fan and chiller plant energy consumptions, the AHU fan consumption power (or energy) of each AHU may be used to learn the fan energy consumption function, and the chiller coefficient of performance and chiller consumption power may be used to calculate the chiller plant energy consumption function. The cool air supply rate data from the sensors are used in the SIDMB to derive both the zone thermal dynamic model, and an inter-zone cool air supply rate coupling model.

In various example embodiments, the SIDMB or zone model generator 440 may further obtain sensor data such as outdoor temperature and humidity. The outdoor temperature and humidity sensor data may be optional and may not be obtained in some embodiments.

In various example embodiments, the zone humidity and carbon dioxide measurements may be used to generate prediction models about how humidity and carbon dioxide concentrations evolve over time with respect to the cool air supply in the zone model generator. According the ASHRAE standard, the zone humidity and carbon dioxide concentration need to be below certain values. To bring down these values, more cool air needs to be pumped into the zone to ensure a healthy environment, which determines the minimum cool air supply rate value for each zone.

Figure 5:
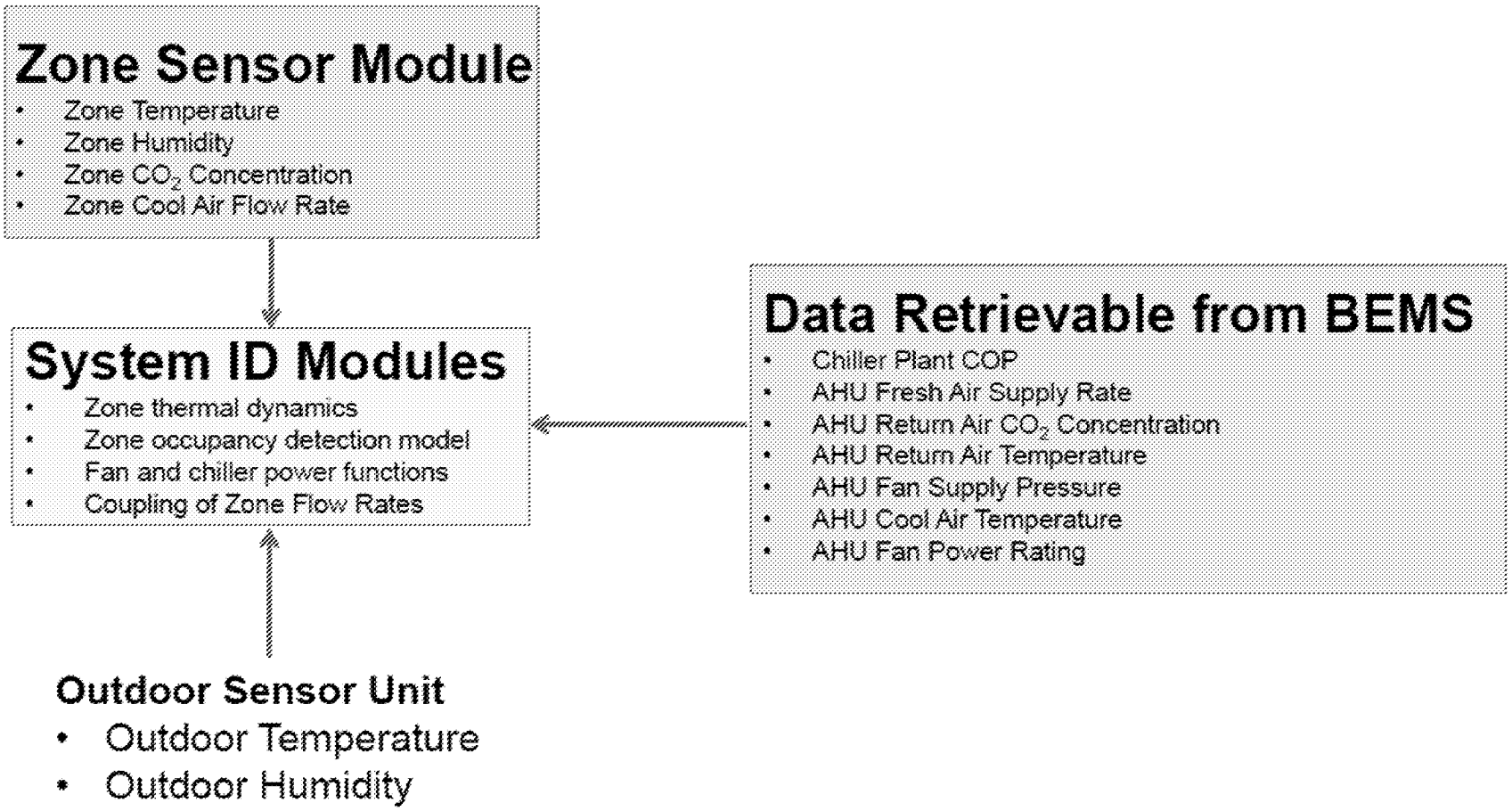
FIG. 5 depicts data sources of the different sensor data for the SIDMB or zone model generator, according to various example embodiments.

In various example embodiments, the sensor data including the zone temperature, zone humidity, zone carbon dioxide concentration and zone cool air supply rate may be obtained using a zone sensor module. The zone sensor module may be a highly modular and mobile sensor package. The zone sensor module may be installed in each zone. The sensor data including the AHU exit cool air temperature, AHU fan exit air pressure, AHU return air $CO_2$ concentration, AHU return air temperature, AHU fan consumption power (or energy), AHU fresh air supply rate and chiller coefficient of performance (COP) and chiller consumption power may be obtained via the BEMS of a target building. As for the outdoor temperature and humidity sensor data, it may be obtained from the BEMS or a dedicated outdoor sensor unit. For a better performance, the outdoor temperature and humidity sensor data may be part of zone sensor data to distinguish the impact difference of outdoor environment to each individual zone. FIG. 5 depicts the data sources of the different sensor data for the SIDMB or zone model generator, according to various example embodiments.

In various example embodiments, the OZTPB or zone occupant thermal preference determinator 450 obtains data from the zone sensor module in relation to zone temperature, zone humidity, zone $CO_2$ concentration and zone cool air (mass) flow rate, and decides the most suitable zone thermal set-point. The zone occupant thermal preference determinator 450 may include several options for determining the zone thermal setpoint. The first option may be a standard industry practice, where the set-point is a static zone temperature range determined by regulations set by relevant authorities (e.g., BCA in Singapore). The second option may be to allow an occupant to input or set explicitly in real time, possibly remotely via an application (or App) that is linked to the zone occupant thermal preference determinator through a network connection. This option for example appears in existing smart HVAC control products or smart thermostats. The third option may be to facilitate an automated human comfort identification and prediction based on advanced models of measurable human physiological responses to ambient conditions. The OZTPB or zone occupant thermal preference determinator 450 may provide an interface that can easily integrate future human comfort technologies into the TBSA architecture, making it more flexible and adaptive than the existing HVAC scheduling technologies.

In various example embodiments, the SCIB or zone schedule controller 460 may obtain the current zone ambient measurements (e.g., zone temperature measurement data with respect to a current time) from the zone sensor module, the zone thermal dynamic model from the SIDMB or zone model generator 440, and the cool air (mass) flow rate schedule from TBSA module or scheduler 430, determines a desirable zone set-point schedule (the thermal set-point trajectory over time or time horizon) (corresponding to the "sequence of zone controller set-points" as described hereinbefore according to various embodiments), and sends a specific set-point at each time instant (e.g., of a time period) based on the schedule to the existing zone VAV controller, which controls the valve opening of the corresponding zone VAV box.

Rate of Data Collection/Sampling Rate (when to Collect the Sensor Data)

In various example embodiments, the sensor data may be collected via a properly coordinated manner. The system 400, which includes the TBSA or scheduler 430, the SIDMB or zone model generator 440, the OZTPB or zone occupant thermal preference determinator 450 and the SCIB or zone schedule controller 460, may operate over discrete time instants. In one exemplary embodiment, the TBSA or scheduler 430 may update its computation once, e.g. every 5-15 minutes in a non-limiting example, as it requires that, after new cooling air is supplied to a zone, the air in the zone shall be fully mixed up, before measurements of zone temperature, zone humidity and zone $CO_2$ concentration are taken. The zone sensor module, on the other hand, may acquire or take sensor measurements at higher rates, such as 1-5 minutes/data in a non-limiting example, than the one for the TBSA or scheduler 430, in order to obtain sufficient data for the sake of model identification or learning (e.g., via machine learning). The outdoor temperature and humidity measurements may be taken at the same rate as the TBSA or scheduler 430 decision-making rate. The sensor data from AHU sensors, available via BEMS, about fresh air supply rate, return air temperature and $CO_2$ concentration, exit cool air temperature, fan supply pressure and fan power meter readings are sampled at a higher rate, such as 1 minute/data in a non-limiting example. The chiller COP data may be requested from the BEMS with a higher sampling rate than the one used in the TBSA or scheduler 430, in order to collect sufficient data for model identification or learning. All these sensor data will be automatically retrieved within the information architecture as described according to various example embodiments.

Data Processing (how to Process Those Data)

In various example embodiments, upon receiving relevant data from the zone sensor modules and BEMS, several data processing techniques are implemented in the SIDMB or zone model generator 440 and the OZTPB or zone occupant thermal preference determinator 450. For example, as disclosed in the above-mentioned PCT International Publication No. WO 2016/148651 A1, in the TBSA or scheduler 430, the following scheduling problem is solved in a distributed manner with a model predictive control scheme:

Equation (1)

$$\min J = \sum_{k=1}^{N}\left(\sum_{u} P_{u,f}(\dot{m}_1(k), \ldots, \dot{m}_2(k)) + P_c(\dot{m}_1(k), \ldots, \dot{m}_2(k))\right)\Delta$$

subject to: $(\forall r \in \{1, \ldots, z\})(\forall k)T_r(k+1) = f_r(T_r(k), \dot{m}_r(k), T_c(k), Q_r(k))$ (i) Equation (2)

$(\forall r \in \{1, \ldots, z\})(\forall k)T_{r,l}(k) \le T_r(k) \le T_{r,u}(k)$ (ii) Equation (3)

$(\forall k)(\forall u)h(A_{u_1}(k), \ldots, A_{u_z}(k), p_u) = (\dot{m}_{u_1}(k), \ldots, \dot{m}_{u_2}(k))$ (iii) Equation (4)

where u denotes one specific air handling unit (AHU), $P_{u,f}(k)$ denotes the fan power function of AHU u during the discrete time interval k, $P_c(k)$ denotes the chiller power function during the discrete time interval k, Δ denotes the sampling period, i.e., the length of the chosen discrete-time interval, z denotes the number of zones in a target building, $\{u_1, \ldots, u_z\}$ denotes individual zones associated to or in AHU u, $f_r$ denotes the thermal dynamic model of zone r, $T_r(k)$ denotes temperature of zone r during the discrete time interval k, $\dot{m}_r(k)$ denotes mass flow rate of cool air supply in zone r during k, $T_c(k)$ denotes temperature of cool air supply during the discrete time interval k, $Q_r(k)$ denotes ambient cooling load of zone r during the discrete time interval k, $[T_{r,l}(k), T_{r,u}(k)]$ denote thermal set-point of zone r, i.e., lower/upper bounds of temperature, h denotes coupling of zone flow rates, zone damper openings, AHU supply pressure, $A_{u_r}$ denotes VAV damper opening of zone $u_r$ associated to or in AHU u during k, and $p_u$ denotes fan supply air pressure in AHU u.

In case that a given VAV controller does not provide any information of the damper opening, the constraint (iii) may be simplified as $h(\dot{m}_{u_1}(k), \ldots, \dot{m}_{u_z}(k), p_u)=0$.

Figure 6:
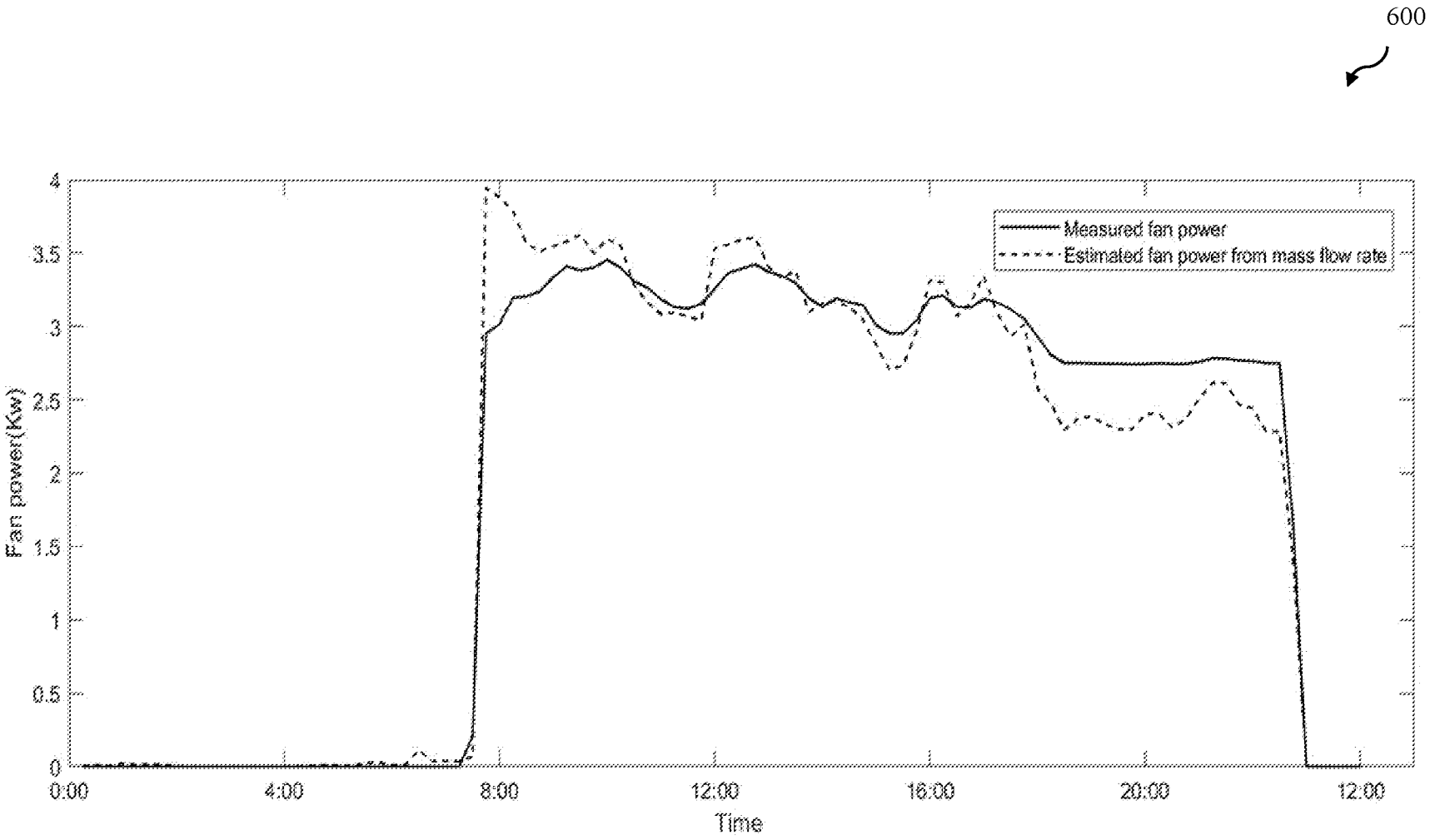
FIG. 6 shows a graph illustrating the experimental result for fan power function identification, according to various example embodiments.

In various example embodiments, to implement the TBSA strategy, several models as follows may be obtained via sensor data (the models are learned based on the sensor data).

i) Fan power consumption function of AHU u, $P_{u,f}$ which may be derivable via either a regression model or a machine-learning based model in the SIDMB or zone model generator 440. For example, the following regression model, $$P_{u,f}(k) = \left(\sum_{i=1}^{N_u} \alpha_{i,u}\dot{m}_{i,u}(k) + \dot{m}_u(k)\right)^{b_u}$$

may be adopted, where $N_u$ denotes the number of controlled zones associated to or in AHU u, $a_{i,u}$ and $b_u$ are parameters that need to be determined, $\dot{m}_{i,u}(k)$ denotes the cool air supply rate at k in zone i of AHU u, and $\dot{m}_u(k)$ denotes the lump-sum unmeasurable cool air supply rate at k in AHU u, which also needs to be determined. It is likely that both parameters $a_{i,u}$ and $b_u$ and the unknown lump-sum cool air supply rate $\dot{m}_u(k)$ are time variant. However, it is assumed that they are constant during a specific prediction horizon, which is typically true in practice when the AHU is in a steady state. With measurements of $P_{u,f}(k)$ and $\dot{m}_u(k)$, the non-linear regression problem may be solved by transforming it into a linear regression problem first and applying the standard least mean squares (LMS) method. FIG. 6 shows a graph 600 illustrating the experimental result for fan power function identification, derived from a test-bed at Nanyang Technological University, indicating its effectiveness. More particularly, graph 600 illustrates the effectiveness of the learned fan power consumption function in the SIDMB or zone model generator 440.

ii) Chiller power function, $P_c$ derivable via machine learning in the SIDMB or zone model generator 440.

iii) Zone thermal dynamic model, $f_r$ which is taken as a bilinear model.

Equation (5)

$$T_r(k+1) = f_r(T_r(k), \dot{m}_r(k), T_c(k), Q_r(k)) = a_r(k)T_r(k) - b_r(k)\dot{m}_r(k)(T_r(k) - T_c(k)) + Q_r(k)$$

By introducing a new variable $\dot{g}_r(k)$ BEGINITALm:=$m_r(k)(T_r(k)-T_c(k))$, the following may be obtained.

Figure 7:
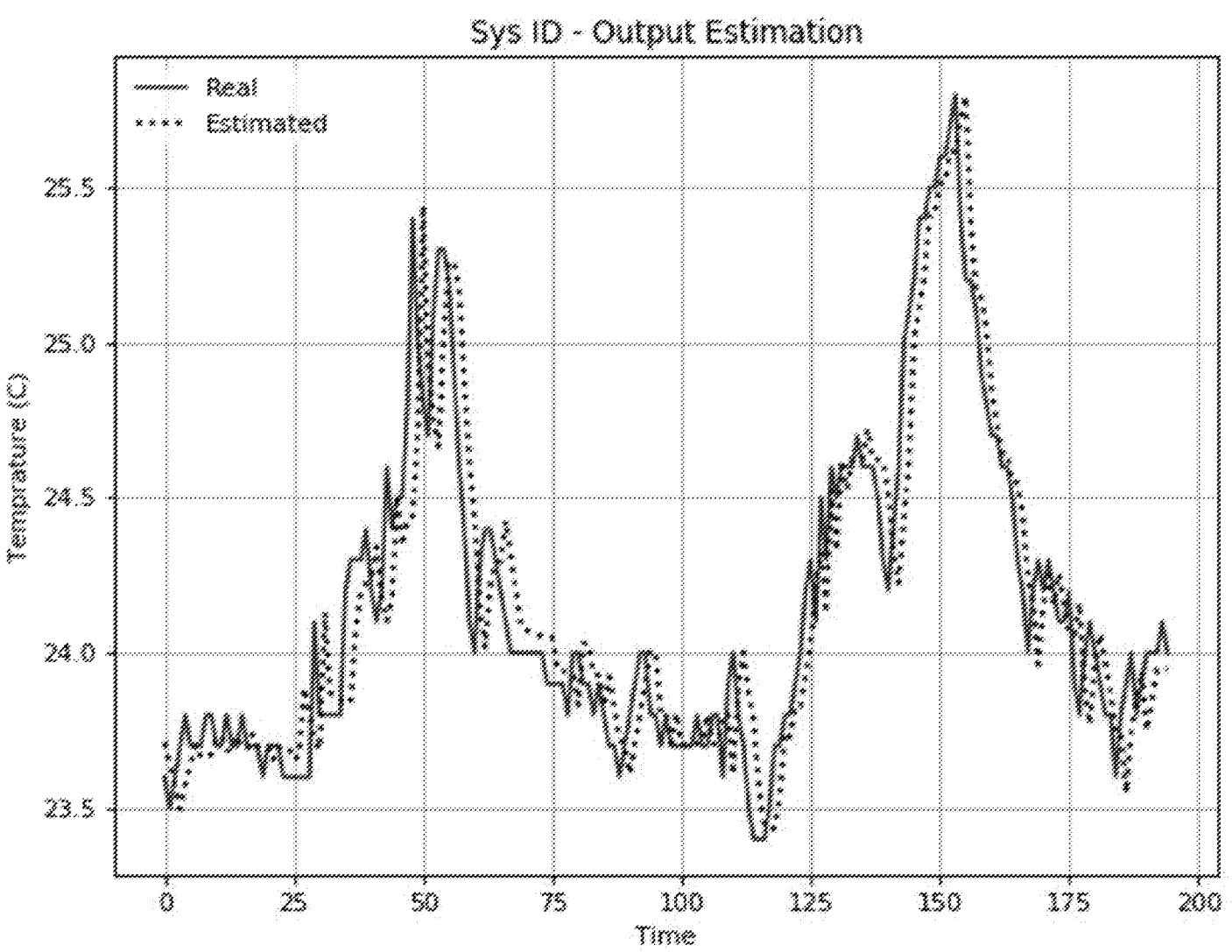
FIG. 7 shows a graph illustrating a good correspondence between measured zone temperature associated to a zone and estimated zone temperature associated to the zone, according to various example embodiments of the present invention.

Equation (6)

$$T_r(k+1)=a_r(k)T_r(k)-b_r(k)\dot{g}_r(k)+Q_r(k),$$

which states that the zone temperature $T_r(k+1)$ at time interval k+1 is determined by the linear combination of the zone temperature $T_r(k)$ at k, the total cooling energy $\dot{g}_r(k)$ generated by the supplied cool air at k, and the ambient cooling load $Q_r(k)$ at k. Since the model is linear, parameters $a_r(k)$, $b_r(k)$ and $Q_r(k)$ can be identified effectively in the SIDMB or zone model generator 440. In the approach according to various example embodiments, the ambient cooling load $Q_r(k)$ is considered piecewise constant, as the change of ambient conditions is a slow process compared with zone thermal dynamics. The outcome seems quite effective, as shown in graph 700 in FIG. 7. More particularly, FIG. 7 shows a graph 700 illustrating a good correspondence between measured zone temperature associated to a zone and estimated zone temperature associated to the zone.

Figure 8:
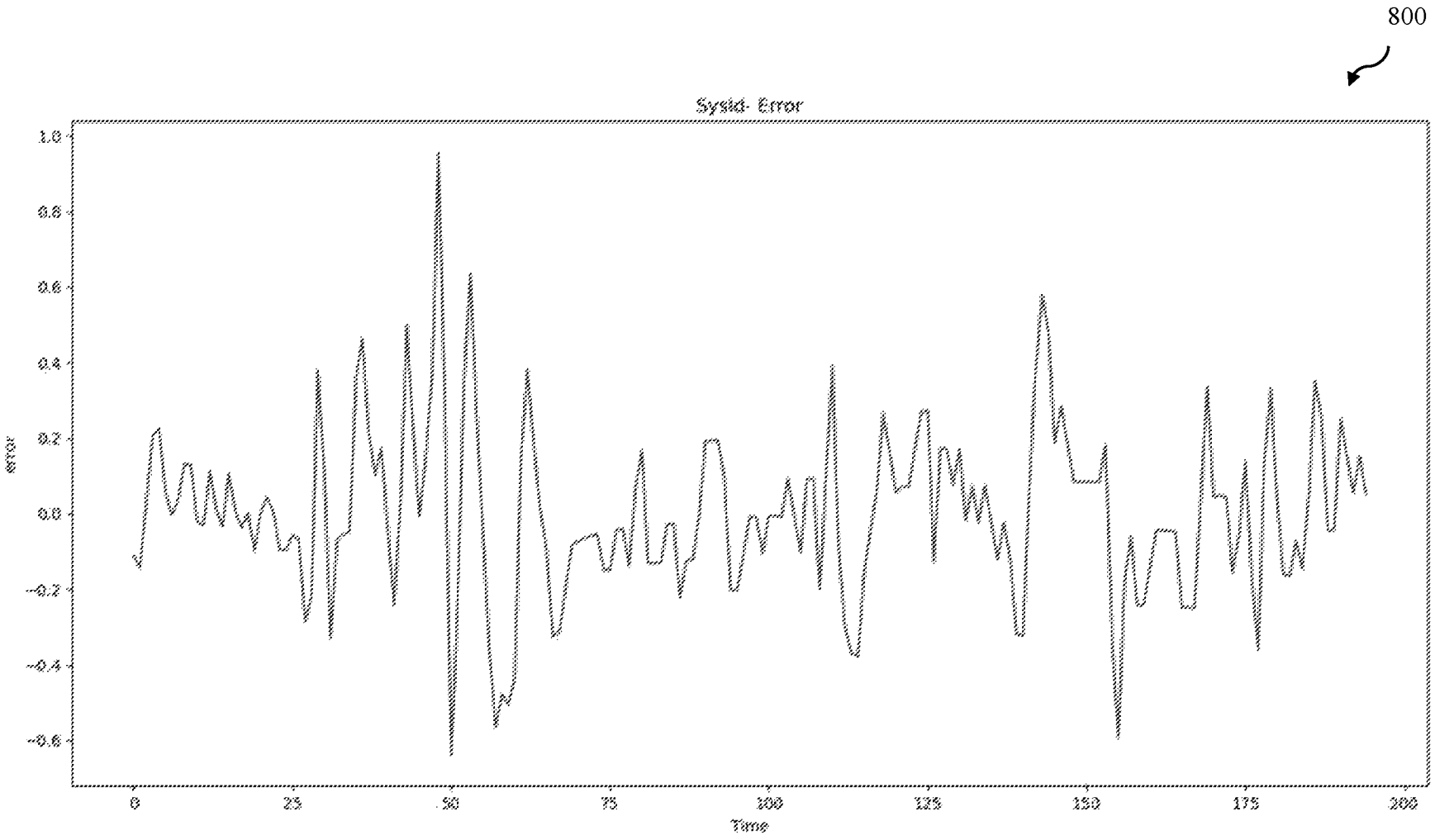
FIG. 8 shows a graph illustrating experimental results for zone thermal dynamic model identification, according to various example embodiments of the present invention.

FIG. 8 shows a graph 800 illustrating experimental results for zone thermal dynamic model identification (e.g., the learned zone thermal dynamic model).

iv) Coupling function h of zone flow rates and AHU supply pressure, which can be learned via machine learning in the SIDMB or zone model generator 440. More explicitly, if the AHU fan supply pressure $p_u(k)$ and each zone damper opening $A_{u_r}(k)$ for zone r of AHU u are given (e.g., a zone damper opening associated with zone r in AHU u), with the assumption that the zone pressure is constant, which is typically true, each zone's cool air supply rate $\dot{m}_{u_i}(k)$ can be uniquely determined. This suggests that there exists a vector-valued function $h(A_{u_1}(k), \ldots, A_{u_z}(k), p_u)=(\dot{m}_{u_1}(k), \ldots, \dot{m}_{u_z}(k))$. However, the actual function of h is highly non-linear and unlikely to be derived analytically, considering that it is determined by the actual layout of the air duct network. However, the zone damper openings in VAV boxes and zone cool air flow or supply rates may be directly measured by zone modules and the AHU fan supply pressure may be directly measured via Building Energy Management System (BEMS). Thus, by using the state-of-art machine learning techniques, the coupling function h may be approximated properly. Identification of such a coupling function allows the token-based strategy to be implemented in any VAV all-air HVAC system without any prior knowledge of the AHU duct layout, which facilitates plug-and-play.

Real-time thermal set-point of zone r$[T_{r,l}(k), T_{r,u}(k)]$ may be generated by the OZTPB or zone occupant thermal preference determinator 450, where $T_{r,l}(k)$ and $T_{r,u}(k)$ refer to lower and upper zone temperature bounds, respectively. The current industry practice in Singapore is to use predetermined static set-points, e.g., [23° C., 26° C.] during working hours, and [28° C., 30° C.] during night hours. Some recent patent publications describe allowing an occupant to online input his/her thermal preference, which will be combined with other occupants' preferred set-points to generate an average set-point. By using zone $CO_2$ measurements, the OZTPB or zone occupant thermal preference determinator 450 can determine whether the zone is occupied with a prediction model derived via machine learning, such as using an occupancy detection algorithm described in Jiang et al. (2020). Bayesian filtering for building occupancy estimation from carbon dioxide concentration. Energy and Buildings, vol. 206, pp. 109566. If no occupancy is detected, the zone temperature can be set higher, e.g., using the set-point for night hours. In various example embodiments, the SIDMB or zone model generator learns the zone occupancy detection model and the sends it to OZTPB or zone occupant thermal preference determinator, which determines the occupants' preferred thermal set-points. The scheduler then receives the occupants' preferred thermal set-points. The scheduler performs scheduling based on the occupants' preferred thermal set-points.

Figure 9:
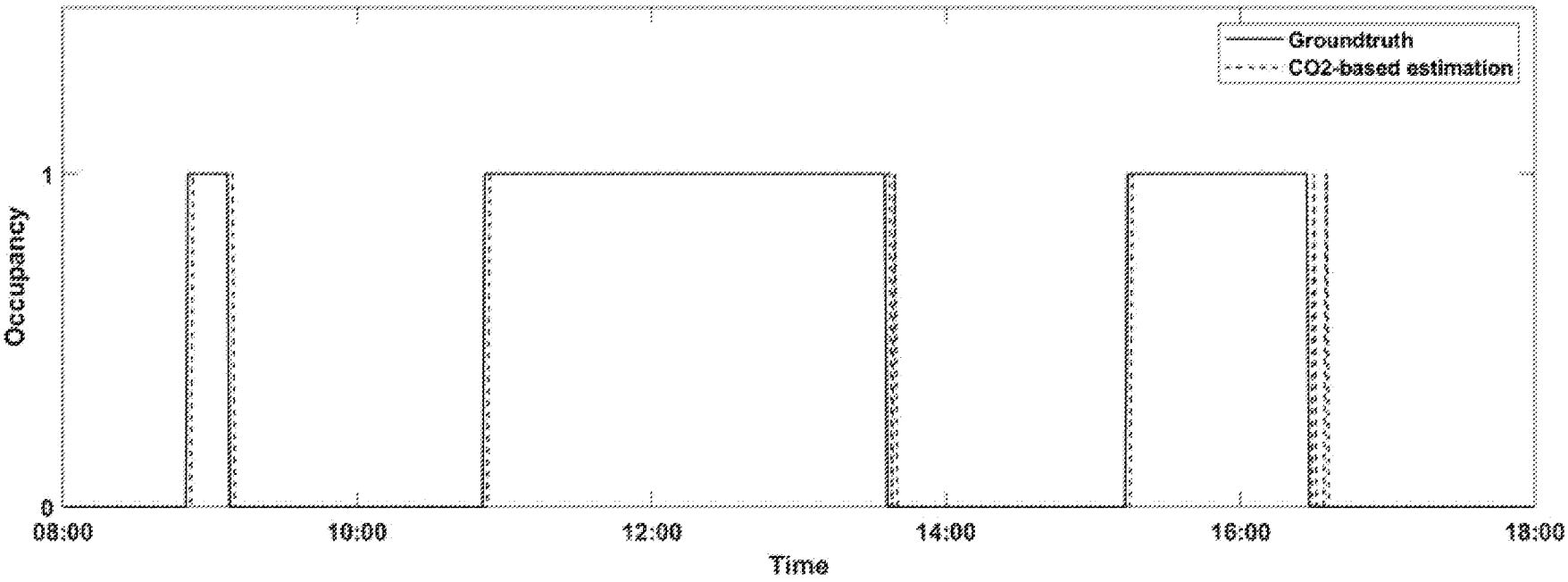
FIG. 9 shows a graph illustrating experimental results for carbon dioxide-based zone occupancy detection, according to various example embodiments of the present invention.

FIG. 9 shows a graph 900 illustrating experimental results for $CO_2$-based zone occupancy detection. For example, if the zone is not occupied, the thermal set-point of the zone may be simply set statically, e.g., [28° C., 30° C.], otherwise, the thermal set-point of the zone may be set to the predetermined static value for the case where the zone is occupied such as [23° C., 26° C.]. For example, when there is no occupancy, the scheduler may simply set the zone thermal set-point to a high value, therefore the zone does not require cooling. For a zone, which is occupied, its pre-declared zone thermal set-point from the OZTPB may be used by the scheduler.

In short, the OZTPB or zone occupant thermal preference determinator 450 may facilitate both static thermal set-points with $CO_2$-based occupancy detection, and dynamic thermal set-points with individualized thermal comfort modeling depending on application.

A multi-zone HVAC system according to various example embodiments comprises:

i) a zone sensor module (or zone module, ZM) comprising a plurality of sensors configured to measure building ambient parameters or data for each zone;

ii) a zone model generator configured to learn models and to receive the measured parameters or data from the zone module and to predict environmental conditions within the zone (for example, learned models of the zone thermal dynamics and $CO_2$ concentration may be used for prediction of how zone temperature and $CO_2$ concentration evolve over time);

iii) a scheduler configured to receive the measured parameters or data from the zone module and the predicted environmental conditions from the zone model generator and to determine an optimal cool air mass flow rate schedule;

iv) a zone schedule controller configured to receive the measured parameters or data from the zone module, the predicted environmental conditions from the zone model generator and the optimal cool air mass flow rate schedule from the scheduler, to determine a zone set-point corresponding to the optimal cool air mass flow rate schedule (corresponding to determine a sequence of zone controller set-points corresponding to the sequence of optimal cool air supply rates as described hereinbefore according to various embodiments), and to send the determined zone set-point to a Variable Air Volume (VAV) controller of the zone (corresponding to send the sequence of zone controller set-points to a zone controller as described hereinbefore according to various embodiments).

Accordingly, various example embodiments provide a specific scalable and adaptive information architecture as described with respect to FIG. 4, which determines what data is to be collected, when the data is to be collected, and how the data to be processed, in order to facilitate actual deployment of the TBSA module or scheduler as described in the above-mentioned PCT International Publication No. WO 2016/148651 A1.

Figure 10:
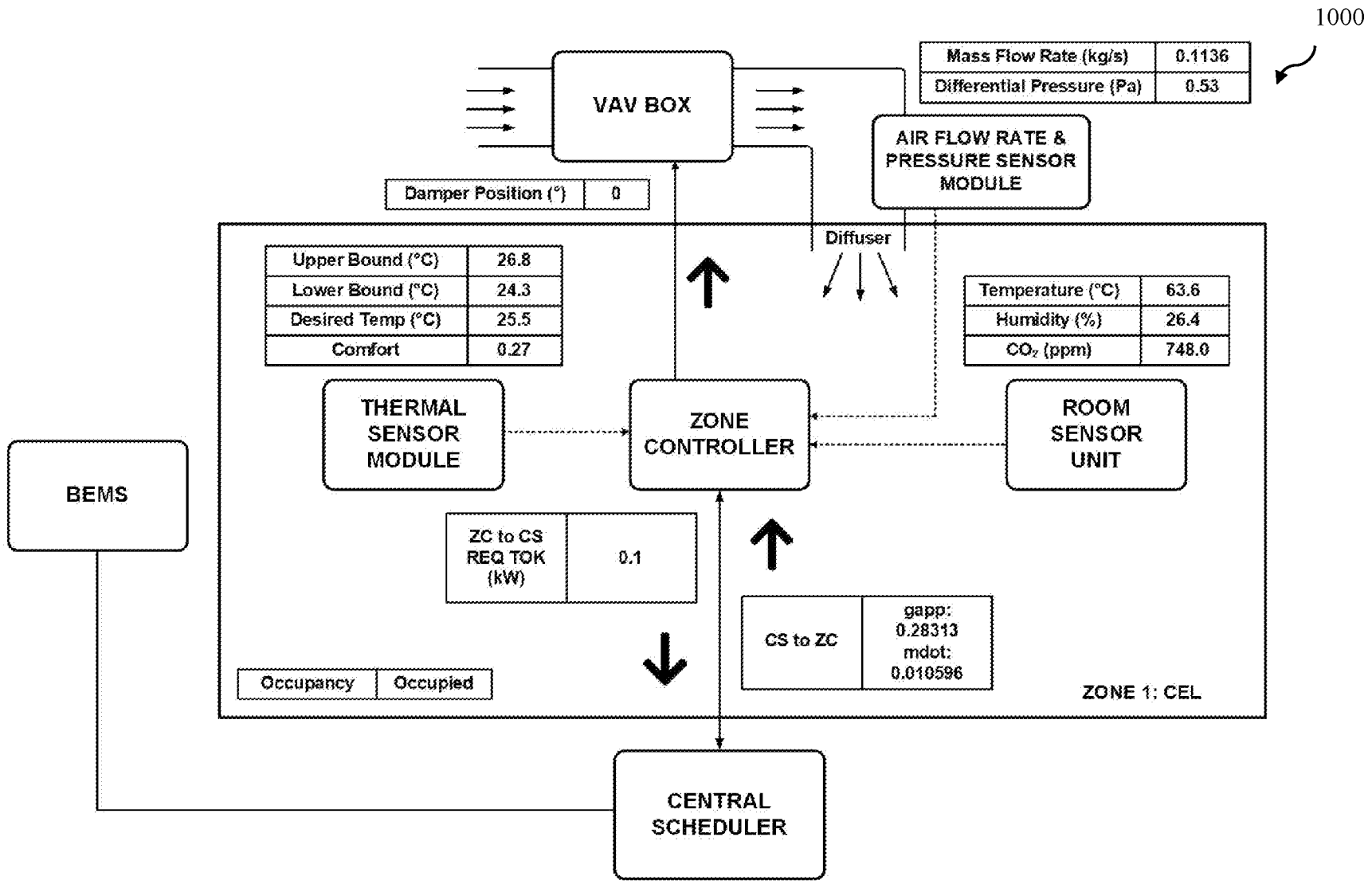
FIG. 10 illustrates a network according to various example embodiments of the present invention.

FIG. 10 illustrates a network 1000 according to various example embodiments of the present invention. The network 1000 may be an adaptive and deployable physical network. The network comprises three parts linked together either wirelessly or via network cable.

In various example embodiments, the network 1000 comprises (a) A Zone Module (ZM), which comprises a detachable Room Sensor Unit (for zone humidity, zone temperature and zone $CO_2$ concentration measurement), a detachable Pressure Sensor Unit (for zone cool air flow rate measurement), a Thermal Sensor Module for measuring zone temperature (e.g., ambient temperature measurement), and a Zone Controller (ZC) that hosts SCIB or zone schedule controller 460 (to interact with the VAV Controller) and other zone model identification algorithms, i.e., identification of zone thermal dynamic model, $CO_2$-based occupancy detection. In other words, each zone module contains a zone controller. Local computation of zone-level token generation in the TBSA also takes place in the ZC. The OZTPB or zone occupant thermal preference determinator 450 may be hosted in the zone module, ZM. In other words, the OZTPB is contained in each ZM.

In various example embodiments, the network 1000 further comprises (b) a Central Scheduler (CS), which is connected with ZM and BEMS, and hosts identification algorithms for each AHU fan power function, the chiller power function, and the coupling of zone mass flow rates with the AHU fan supply pressure, together with the token allocation part of the token-based HVAC scheduling approach. For example, the learned models of the zone model generator may be hosted by the zone modules and the central scheduler, based on actual models to be learned. The Central Scheduler may reside in a high-performance computer.

The interactions between ZC and CS may be as follows:

For ZM:

ZM1: Information processing of weather forecasts, user set-points, occupancy

ZM2: Forecast zone cooling load in future windows

ZM3: Compute token requests for cooling service over various future windows

ZM4: Update local zone thermal model

ZM5: Execute cool air supply schedule from CS

For CS:

CS1: Gather token requests from all Zone Modules

CS2: Interrogate system state: indoor air quality, chiller efficiencies, dampers positions CS3: Compute constraints to meet requirements on air quality, minimum duct pressure CS4: Allocate tokens to each zone to minimize energy use subject to constraints The above-mentioned PCT International Publication No. WO 2016/148651 A1 describes how ZC and CS interact with each other to establish the TBSA. In the following, how other physical components in FIG. 10 work is described.

To describe detailed operations of each physical component, the sampling period for the ZC and CS may be assumed to be Δ, i.e., ZC and CS generate a new zone mass flow rate schedule at the end of each Δ. The sampling period for the Room Sensor Unit (RSU) and Pressure Sensor Unit (PSU) (or Module) is shorter, e.g., chosen as Δ/3. This will allow sufficient sensor data to be generated for a model identification purpose. The sampling periods for AHU fan power consumption, return air $CO_2$ concentration and temperature, chiller COP and power consumption must be sufficiently high, e.g., no bigger than Δ/3, to ensure a good number of data for subsequent model identification.

The sampled zone temperature data from RSU and air flow rate data from PSU are fed in ZC, where identification (learning and generating a learned model or more particularly, model parameters) of the zone thermal dynamic model and $CO_2$-based occupancy detection take place. The model identification process comprises two phases: offline learning in Phase 1, where ZC simply sends a static zone thermal set-point to the VAV controller, while collecting data from RSU and PSU to derive a sufficiently good thermal dynamic model and occupancy detection model, with an assumption that there are persistent patterns in the system about the zone ambient cooling load $Q_r(k)$ and the $CO_2$ concentration evolution with respect to the zone occupancy status; and online model update in Phase 2, where ZC runs the model identification algorithm to do some minor model updates (iteratively update the learned models based on newly received sensor data), while operating in the TBSA mode with a forecast of zone thermal dynamics derived from the offline-attained dynamic model and a forecast of zone occupancy derived from the offline-attained $CO_2$-based occupancy detection model.

In various example embodiments, the OZTPB or zone occupant thermal preference determinator 450 may have two different working modes: the static thermal set-point mode and the dynamic thermal set-point mode. In the static mode, the OZTPB or zone occupant thermal preference determinator 450 outputs a pre-determined thermal set-point to ZC. In the dynamic mode, the OZTPB or zone occupant thermal preference determinator 450 undertakes an offline learning process that generates an individualized thermal comfort model, describing whether a specific zone thermal setting (e.g., zone temperature, zone humidity and zone air flow rate from RSU and PSU) is comfortable. With this model, the OZTPB or zone occupant thermal preference determinator 450 may determine a suitable zone thermal set-point and send it to the ZC during the TBSA mode, while continuously collecting online data for further offline model updates.

The sampled AHU and chiller plant data retrievable from BEMS and the zone cool air flow rates from each ZC (or directly from each PSU) are fed in CS, where identifications of the fan power consumption function, chiller power consumption function, and the coupling relationship among all zone cool air mass flow rates and the AHU fan supply pressure take place. The model identification process is done offline, and those generated models will be used in the cost function and constraints in the token allocation stage of the token-based HVAC scheduling mode, whereas online data are continuously collected for subsequent offline model tuning in a model predictive control (MPC) manner.

Figure 11:
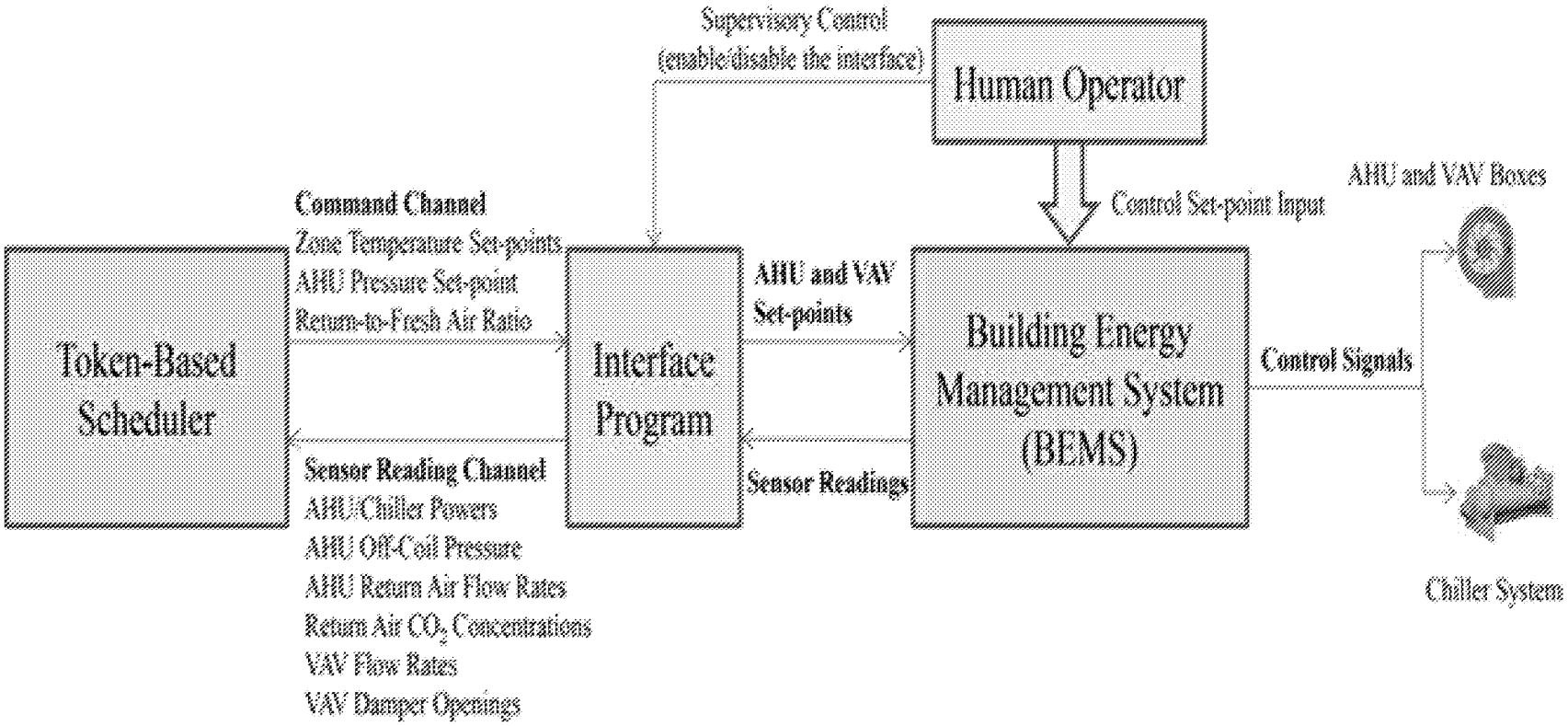
FIG. 11 depicts an architecture which allows a user to easily switch between a TBSA strategy and a standard static thermal set-point tracking strategy, by enabling and disabling a zone schedule controller according to various example embodiments of the present invention, in the architecture.

Various example embodiments of the present the invention may be embedded in the architecture illustrated in FIG. 11 that allows a user to easily switch between the TBSA strategy and a standard static thermal set-point tracking strategy, by enabling and disabling the SCIB or zone schedule controller 460 in the architecture, which connects the implementation architecture according to example various embodiments and each existing VAV controller. Such enabling and disabling commands can be either issued from BEMS, i.e., the implementation architecture according to example various embodiments may be part of an enhanced BEMS, or a stand-alone part of a building automation system, if the user does not want to make any change in an existing BEMS. Because of the highly mobile nature of the deployment architecture, it can be easily created on the site with a set of ZM and a CS, together with a properly configured (wireless or cabled) network, without any major retrofitting need for an existing all-air VAV HVAC system in various example embodiments.

FIG. 12 shows a table illustrating experimental data for energy saving potential based on data from a test-bed at NTU according to various example embodiments of the present invention. As illustrated in the table, significant energy savings may be anticipated. Accordingly, various example embodiments of the present invention ensure a good tradeoff between the retrofit cost and energy saving potential, making it commercially viable.

While embodiments of the invention have been particularly shown and described with reference to specific embodiments, it should be understood by those skilled in the art that various changes in form and detail may be made therein without departing from the scope of the invention as defined by the appended claims. The scope of the invention is thus indicated by the appended claims and all changes which come within the meaning and range of equivalency of the claims are therefore intended to be embraced.

What is claimed is:

1. A method of controlling an air-conditioning system associated with a building for optimizing a plurality of building performance parameters in providing an environment with respect to a zone of the building, using at least one processor, the method comprising:

obtaining zone environmental condition information including zone temperature data associated to the zone, and cooling air temperature data associated to an air handling unit associated to the zone;

obtaining, from a zone model generator, zone cooling load parameters associated to the zone with respect to a plurality of time periods and a zone thermal dynamic model;

obtaining, from a scheduler, a sequence of optimal cool air supply rates with respect to a plurality of subsequent time periods with respect to the zone determined based on a multi-component cost function including a plurality of components relating to the plurality of building performance parameters;

determining, based on the zone thermal dynamic model, a sequence of zone controller set-points corresponding to the sequence of optimal cool air supply rates with respect to the zone using the zone cooling load parameters, the zone temperature data and the cooling air temperature data associated to the air handling unit; and sending the sequence of zone controller set-points to a zone controller for controlling a temperature of the zone.

2. The method according to claim 1, wherein said obtaining zone environmental condition information including zone temperature data associated to the zone comprises obtaining, from the zone model generator, zone temperature data associated to the zone with respect to the plurality of subsequent time periods.

3. The method according to claim 1, wherein said obtaining zone environmental condition information including zone temperature data associated to the zone comprises obtaining, from a zone sensor module, zone temperature measurement data associated to the zone with respect to a current time.

4. The method according to claim 1, wherein said obtaining cooling air temperature data associated to an air handling unit associated to the zone comprises obtaining the cooling air temperature measurement data associated to the air handling unit associated to the zone with respect to a current time.

5. The method according to claim 1, wherein the zone thermal dynamic model is trained by a model generator based on measured data of zone temperature associated to the zone, zone cool air supply rate associated to the zone and cooling air temperature associated to the air handling unit associated to the zone, or is a function of the zone temperature data, the sequence of optimal cool air supply, the cooling air temperature data, and the zone cooling load parameters, or both.

6. The method according to claim 1, wherein the plurality of components of the multi-component cost function comprise a first component relating to zone occupancy associated to the zone determined based on a zone occupancy detection model, a second component relating to fan power of the air handling unit determined based on a fan power function, a third component relating to chiller power determined based on a chiller power function, a fourth component relating to coupling of a pressure of a supply fan associated to the air handling unit and zone air flow rates corresponding to zones associated to the air handling unit determined based on a coupling function in relation to the pressure of the supply fan associated to the air handling unit and the zone air flow rates corresponding to zones associated to the air handling unit.

7. The method according to claim 1, wherein the plurality of components of the multi-component cost function further comprise a component relating to respective zone cool air supply rate requests corresponding to the zone and one or more other zones in the building with respect to the plurality of subsequent time periods.

8. The method according to claim 1, wherein the plurality of components of the multi-component cost function further comprise a component relating to occupant thermal comfort.

9. The method according to claim 8, wherein the component relating to occupant thermal comfort comprises a thermal set-point obtained from a predetermined value, predicted based on an occupant thermal comfort prediction model or obtained from user input.

10. The method according to claim 9, further comprising predicting, based on the occupant thermal comfort prediction model, the occupant thermal comfort using the zone temperature data, zone humidity data, zone carbon dioxide concentration data and zone cool air supply rate data associated to the zone obtained from a zone sensor module.

11. The method according to claim 1, wherein the zone controller comprises a zone variable air volume controller.

12. A control system for controlling an air-conditioning system associated with a building for optimizing a plurality of building performance parameters in providing an environment with respect to a zone of the building, the control system comprising:

a memory; and at least one processor communicatively coupled to the memory and configured to:

obtain zone environmental condition information including zone temperature data associated to the zone, and cooling air temperature data associated to an air handling unit associated to the zone;

obtain, from a zone model generator, zone cooling load parameters associated to the zone with respect to a plurality of time periods and a zone thermal dynamic model;

obtain, from a scheduler, a sequence of optimal cool air supply rates with respect to the plurality of subsequent time periods with respect to the zone determined based on a multi-component cost function including a plurality of components relating to the plurality of building performance parameters;

determine, based on the zone thermal dynamic model, a sequence of zone controller set-points corresponding to sequence of optimal cool air supply rates with respect to the zone using the zone cooling load parameters, the zone temperature data and the cooling air temperature data associated to the air handling unit; and send the sequence of zone controller set-points to a zone controller for controlling a temperature of the zone.

13. The system according to claim 12, wherein said obtain zone environmental condition information including zone temperature data associated to the zone comprises obtain, from the zone model generator, zone temperature data associated to the zone with respect to the plurality of subsequent time periods.

14. The system according to claim 12, wherein said obtain zone environmental condition information including zone temperature data associated to the zone comprises obtain, from a zone sensor module, zone temperature measurement data associated to the zone with respect to a current time.

15. The system according to claim 12, wherein the zone thermal dynamic model is trained by the model generator based on measured data of zone temperature associated to the zone, zone cool air supply rate associated to the zone and the cool air temperature associated to the air handling unit associated to the zone, or is a function of the zone temperature data, the sequence of optimal cool air supply, the cooling air temperature data, and the zone cooling load parameters, or both.

16. The system according to claim 12, wherein the plurality of components of the multi-component cost function comprise a first component relating to zone occupancy associated to the zone determined based on a zone occupancy detection model, a second component relating to fan power of the air handling determined based on a fan power function, a third component relating to chiller power determined based on a chiller power function, a fourth component relating to coupling of a pressure of a supply fan associated to the air handling unit and zone air flow rates corresponding to zones associated to the air handling unit determined based on a coupling function in relation to the pressure of the supply fan associated to the air handling unit and the zone air flow rates corresponding to the zones associated to the air handling unit.

17. The system according to claim 12, wherein the plurality of components of the multi-component cost function further comprise a component relating to occupant thermal comfort.

18. The system according to claim 17, wherein the component relating to occupant thermal comfort comprises a thermal set-point obtained from a predetermined value, predicted based on an occupant thermal comfort prediction model or obtained from user input.

19. The system according to claim 18, further comprising predicting, based on the occupant thermal comfort prediction model, the occupant thermal comfort using the zone temperature data, zone humidity data, zone carbon dioxide concentration data and zone cool air supply rate data associated to the zone obtained from a zone sensor module.

20. A computer program product, embodied in one or more non-transitory computer-readable storage mediums, comprising instructions executable by at least one processor to perform a method of controlling an air-conditioning system associated with a building for optimizing a plurality of building performance parameters in providing an environment with respect to a zone of the building, the method comprising:

obtaining zone environmental condition information including zone temperature data associated to the zone, and cooling air temperature data associated to an air handling unit associated to the zone;

obtaining, from a zone model generator, zone cooling load parameters associated to the zone with respect to a plurality of time periods and a zone thermal dynamic model;

obtaining, from a scheduler, a sequence of optimal cool air supply rates with respect to a plurality of subsequent time periods with respect to the zone determined based on a multi-component cost function including a plurality of components relating to the plurality of building performance parameters;

determining, based on the zone thermal dynamic model, a sequence of zone controller set-points corresponding to the sequence of optimal cool air supply rates with respect to the zone using the zone cooling load parameters, the zone temperature data and the cooling air temperature data associated to the air handling unit; and sending the sequence of zone controller set-points to a zone controller for controlling a temperature of the zone.

* * * * *